US007455467B2

(12) United States Patent
Sasaki

(10) Patent No.: US 7,455,467 B2
(45) Date of Patent: Nov. 25, 2008

(54) STICK-SHAPED COSMETIC MATERIAL FEEDING CONTAINER

(75) Inventor: Arata Sasaki, Tokyo (JP)

(73) Assignee: Tokiwa Corporation, Gifu (JP)

( * ) Notice: Subject to any disclaimer, the term of this patent is extended or adjusted under 35 U.S.C. 154(b) by 0 days.

(21) Appl. No.: 11/812,108

(22) Filed: Jun. 15, 2007

(65) Prior Publication Data

US 2008/0019760 A1 Jan. 24, 2008

(30) Foreign Application Priority Data

Jul. 19, 2006 (JP) ..... 2006-197144

(51) Int. Cl.
*A45D 40/20* (2006.01)
*A45D 40/04* (2006.01)

(52) U.S. Cl. ..... 401/88; 401/75; 401/68

(58) Field of Classification Search ..... 401/68, 401/75–78, 88, 92–94
See application file for complete search history.

(56) References Cited

U.S. PATENT DOCUMENTS 3,045,593 A * 7/1962 Petterson ..... 101/368
6,793,429 B2 * 9/2004 Arrison ..... 401/93

FOREIGN PATENT DOCUMENTS

JP 11-075934 3/1999

* cited by examiner

*Primary Examiner*—David J Walczak
(74) *Attorney, Agent, or Firm*—Bacon & Thomas, PLLC

(57) ABSTRACT

To make a container shape slim and compact and prevent breakage of a stick-shaped cosmetic material, a stick-shaped cosmetic material (M) having a cross sectional shape with long and short diameters is used, four support pieces (7*b*) supporting a rear end portion of the cosmetic material (M) support inclined surfaces (Ma) between the long and short diameters, a forward and backward moving hole (4*a*), in which the cosmetic material (M) and the support pieces (7*b*) move, is formed in a cross sectional shape with long and short diameters, and has flat short diameter side inner surfaces (4*aa*), the short diameter side inner surfaces (4*aa*) come close to short-diameter side outer surfaces (Mb) of the cosmetic material (M), and inner surfaces (4*ab*) at the support piece (7*b*) side come close to outer surfaces (7*bb*) at an outer side in the short diameter direction of the support pieces (7*b*).

8 Claims, 18 Drawing Sheets

STICK-SHAPED COSMETIC MATERIAL FEEDING CONTAINER

BACKGROUND OF THE INVENTION

1. Field of the Invention

The present invention relates to a stick-shaped cosmetic material feeding container provided with a stick-shaped cosmetic material support body supporting a rear end portion of a stick-shaped cosmetic material by a plurality of support pieces.

2. Description of the Conventional Art

Conventionally, as a stick-shaped cosmetic material which can draw both of a thin line and a thick line, there has been employed a stick-shaped cosmetic material having an oval cross sectional shape. As a stick-shaped cosmetic material feeding container which can accommodate the stick-shaped cosmetic material having the oval cross sectional shape mentioned above within the container and can take in and out the stick-shaped cosmetic material from an opening in a leading end of the container, there has been known a structure described in Japanese Unexamined Patent Publication No. 11-75934. The stick-shaped cosmetic material feeding container described in Japanese Unexamined Patent Publication No. 11-75934 is structured such that a stick-shaped cosmetic material support body supporting an outer peripheral surface except positions in accordance with a long axis and a short axis in a rear end portion of the stick-shaped cosmetic material is incorporated in the container by four pieces of support pieces, a stick-shaped cosmetic hole capable of moving the stick-shaped cosmetic material forward and backward and a forward and backward moving hole provided with a support piece groove connected to the stick-shaped cosmetic material hole and capable of moving the support pieces forward and backward are provided within the container, the stick-shaped cosmetic material support body is moved forward in the forward and backward moving hole and the stick-shaped cosmetic material appears from the opening in the leading end of the container by being relatively rotated in one direction in accordance with a rotating operation by a user, and the stick-shaped cosmetic material support body is moved backward in the forward and backward moving hole and the stick-shaped cosmetic material is taken in the container by being rotated in the other direction corresponding to an opposite direction to the one direction.

SUMMARY OF THE INVENTION

Problem to be Solved by the Invention

In this case, in the case of using the stick-shaped cosmetic material having such the shape as the oval cross sectional shape mentioned above, there has been carried out research and development for making the leading end side of the container in a slim and compact shape.

Accordingly, an object of the present invention is to provide a stick-shaped cosmetic material feeding container in which a leading end side of a container has a slim and compact shape.

Means for Solving the Problem

In accordance with the present invention, there is provided a stick-shaped cosmetic material feeding container in which the stick-shaped cosmetic material feeding container has a stick-shaped cosmetic material support body supporting a rear end portion of a stick-shaped cosmetic material by a plurality of support pieces, and the stick-shaped cosmetic material is moved forward and backward together with the stick-shaped cosmetic material support body in accordance with an operation of a user, wherein the stick-shaped cosmetic material has a cross sectional shape having a long diameter and a short diameter, inclined surfaces are provided between the long diameter and the short diameter, the number of the support pieces is four, each of the support pieces supports each of the inclined surfaces of the stick-shaped cosmetic material, a forward and backward moving hole in which the stick-shaped cosmetic material and the support pieces are moved forward and backward is formed in a cross sectional shape having a long diameter and a short diameter, flat short diameter side inner peripheral surfaces are provided at the short diameter side, and the short diameter side inner peripheral surfaces come close to an outer peripheral surfaces at the short diameter side of the stick-shaped cosmetic material, and come close to outer peripheral surfaces at an outer side in a short diameter direction of the support pieces.

In accordance with the stick-shaped cosmetic material feeding container mentioned above, there is employed the stick-shaped cosmetic material having the cross sectional shape having the long diameter and the short diameter, four support pieces of the stick-shaped cosmetic material support body supporting the rear end portion of the stick-shaped cosmetic material are structured such as to support each of the inclined surfaces between the long diameter and the short diameter of the stick-shaped cosmetic material, the forward and backward moving hole in which the stick-shaped cosmetic material and the support pieces are moved forward and backward is formed in the cross sectional shape having the long diameter and the short diameter, the flat short diameter side inner peripheral surfaces are provided at the short diameter side, the short diameter side inner peripheral surfaces come close to the outer peripheral surfaces at the short diameter side of the stick-shaped cosmetic material, and the inner peripheral surfaces at the support piece side come close to the outer peripheral surfaces at the outer side in the short diameter direction of the support pieces. Accordingly, it is possible to efficiently accommodate the stick-shaped cosmetic material having the cross sectional shape having the long diameter and the short diameter and the support pieces supporting the stick-shaped cosmetic material within the container so as to be movable forward and backward, and it is possible to make the leading end side of the container in a slim and compact shape. In this case, since the stick-shaped cosmetic material has a small thickness in the short diameter direction, and is comparatively weak against stress in the short diameter direction, there is a risk that the stick-shaped cosmetic material is broken if the stress is applied to the stick-shaped cosmetic material in the short diameter direction. However, since the flat short diameter side inner peripheral surfaces at the short diameter side of the forward and backward moving hole come close to the outer peripheral surfaces at the short diameter side of the stick-shaped cosmetic material, the outer surfaces at the short diameter side of the stick-shaped cosmetic material are immediately borne by the forward and backward moving hole coming close thereto, and it is possible to prevent the stick-shaped cosmetic material from being broken by the stress in the short diameter direction.

In this case, as a shape of the forward and backward moving hole, there can be shown a structure in which an inner peripheral surfaces at the support piece side does not protrude to an outer side in the short diameter direction from the short diameter side inner peripheral surfaces.

Further, it is preferable that the forward and backward moving hole comes close to the outer peripheral surfaces at the long diameter side of the stick-shaped cosmetic material. In the case of employing the structure mentioned above, since the outer surfaces at the long diameter side of the stick-shaped cosmetic material is immediately borne by the forward and backward moving hole coming close thereto, even if stress is applied in the long diameter direction of the stick-shaped cosmetic material, in addition that the stick-shaped cosmetic material has the large thickness in the long diameter direction and is comparatively strong against stress in the long diameter direction so as to be hardly broken, it is possible to prevent the stick-shaped cosmetic material from being broken due to the stress in the long diameter direction.

Further, it is preferable that the forward and backward moving hole is constituted by a hole in which the cross sectional shape is approximately a rectangular shape. In the case of employing the structure mentioned above, the shape of the forward and backward moving hole is made simple, and it is easy to manufacture the forward and backward moving hole.

Effect of the Invention

As mentioned above, in accordance with the present invention, it is possible to provide the stick-shaped cosmetic material feeding container in which breakage of the stick-shaped cosmetic material can be prevented, as well as the stick-shaped cosmetic material feeding container is provided with the stick-shaped cosmetic material having the cross sectional shape having the long diameter and the short diameter, and the leading end side of the container can be formed in the slim and compact shape.

DETAILED DESCRIPTION OF PREFERRED EMBODIMENT

Figure 1:
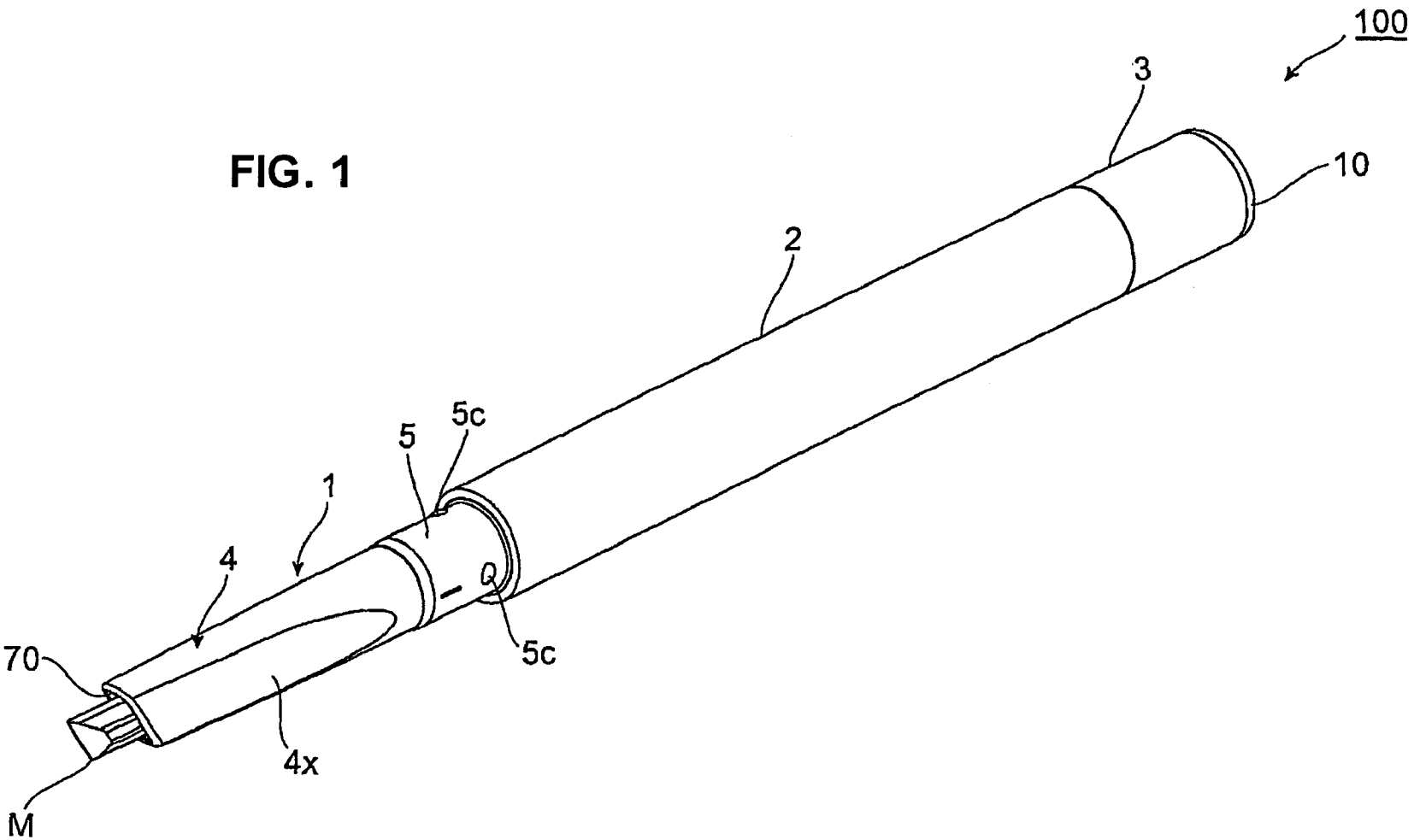
FIG. 1 is a perspective view showing an outer appearance of a stick-shaped cosmetic material feeding container in accordance with a first embodiment of the present invention.

A description will be given below of preferable embodiments of a stick-shaped cosmetic material feeding container in accordance with the present invention with reference to FIGS. 1 to 18. In this case, in each of the drawings, the same reference numerals are attached to the same elements, and an overlapping description will be omitted.

Figure 2:
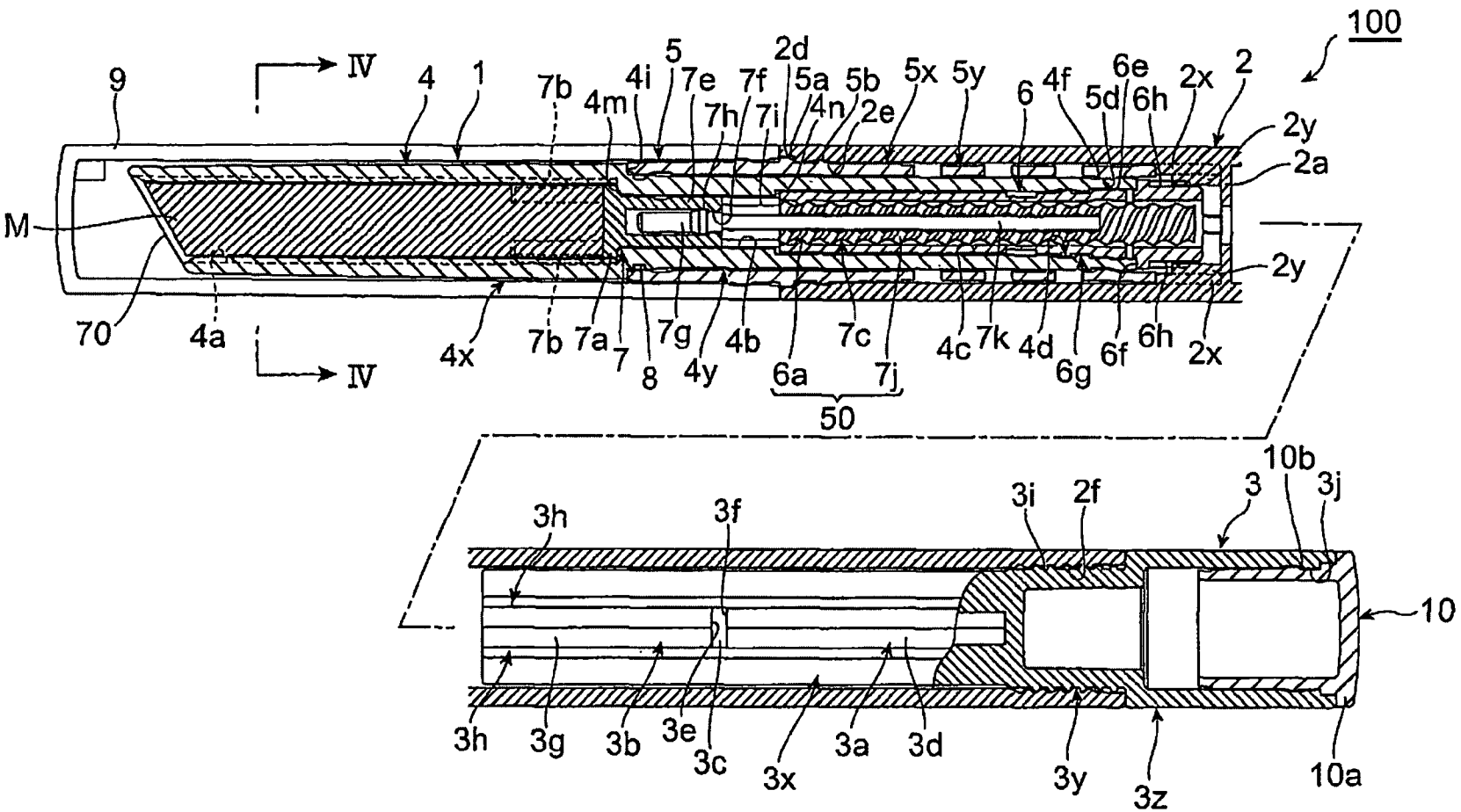
FIG. 2 is a longitudinal sectional view of the stick-shaped cosmetic material feeding container shown in FIG. 1.
Figure 3:
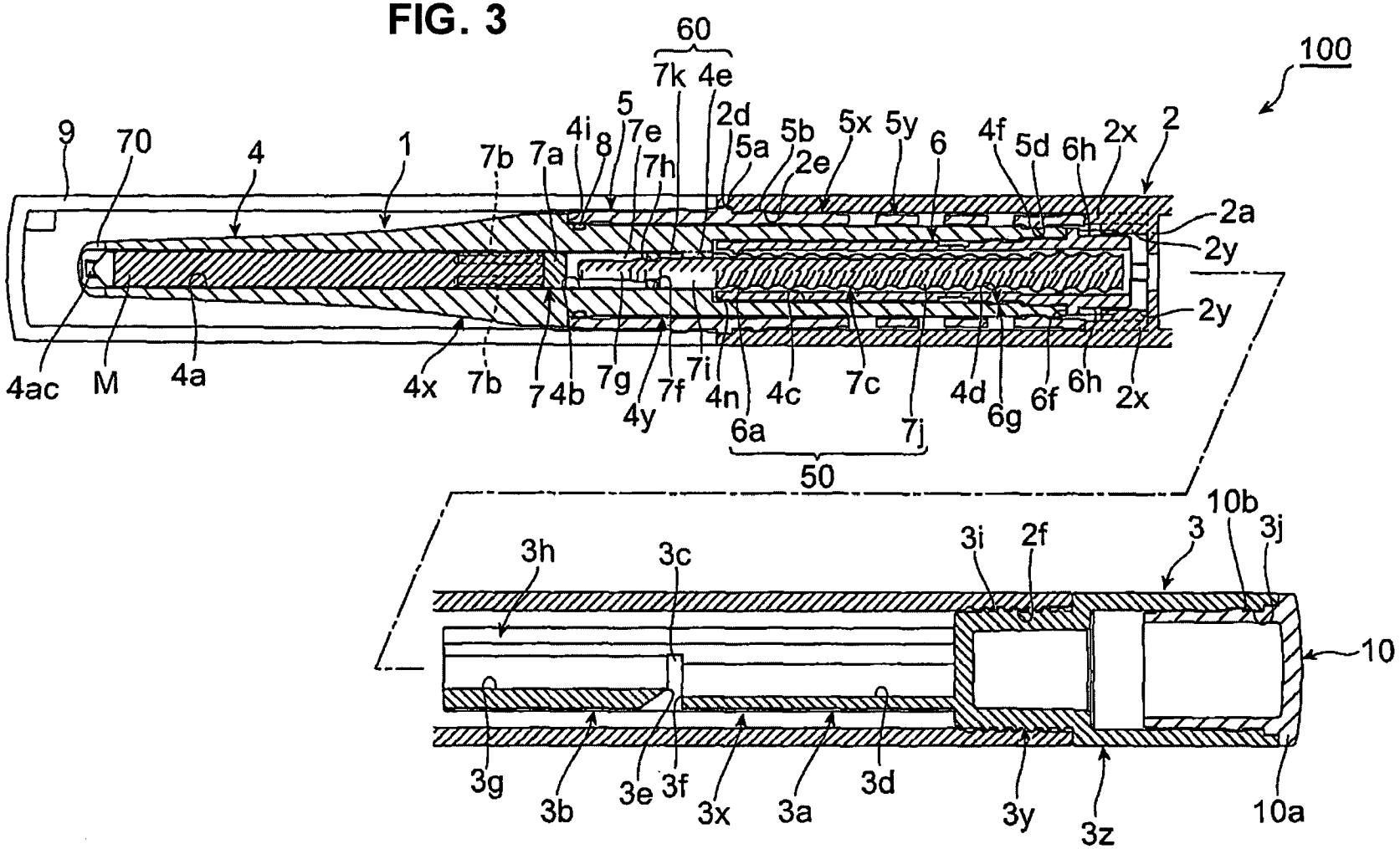
FIG. 3 is an orthogonal longitudinal sectional view of the stick-shaped cosmetic material feeding container shown in FIG. 2.
Figure 7:
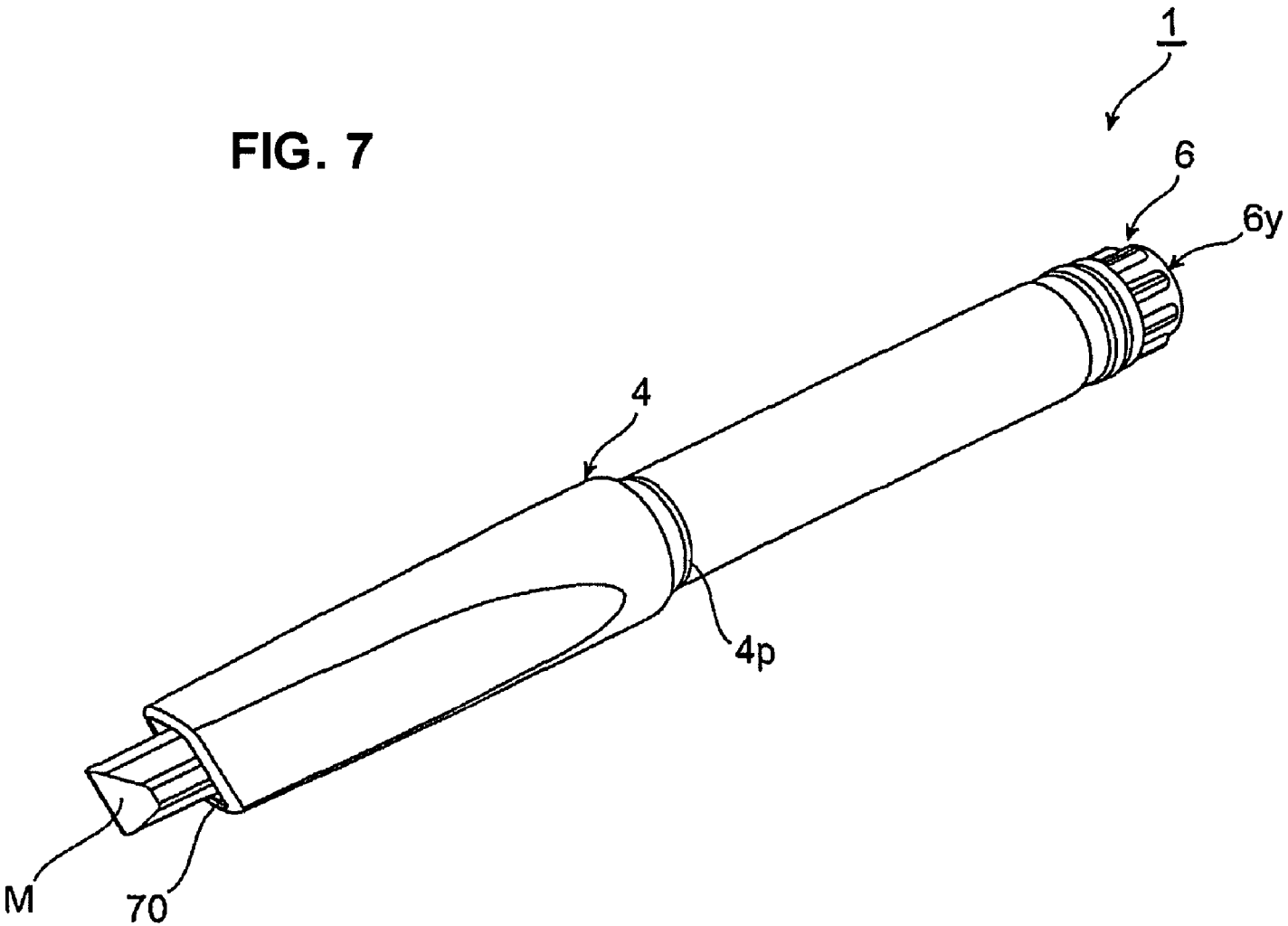
FIG. 7 is a perspective view showing a stick-shaped cosmetic material cartridge in FIGS. 2 and 3.
Figure 8:
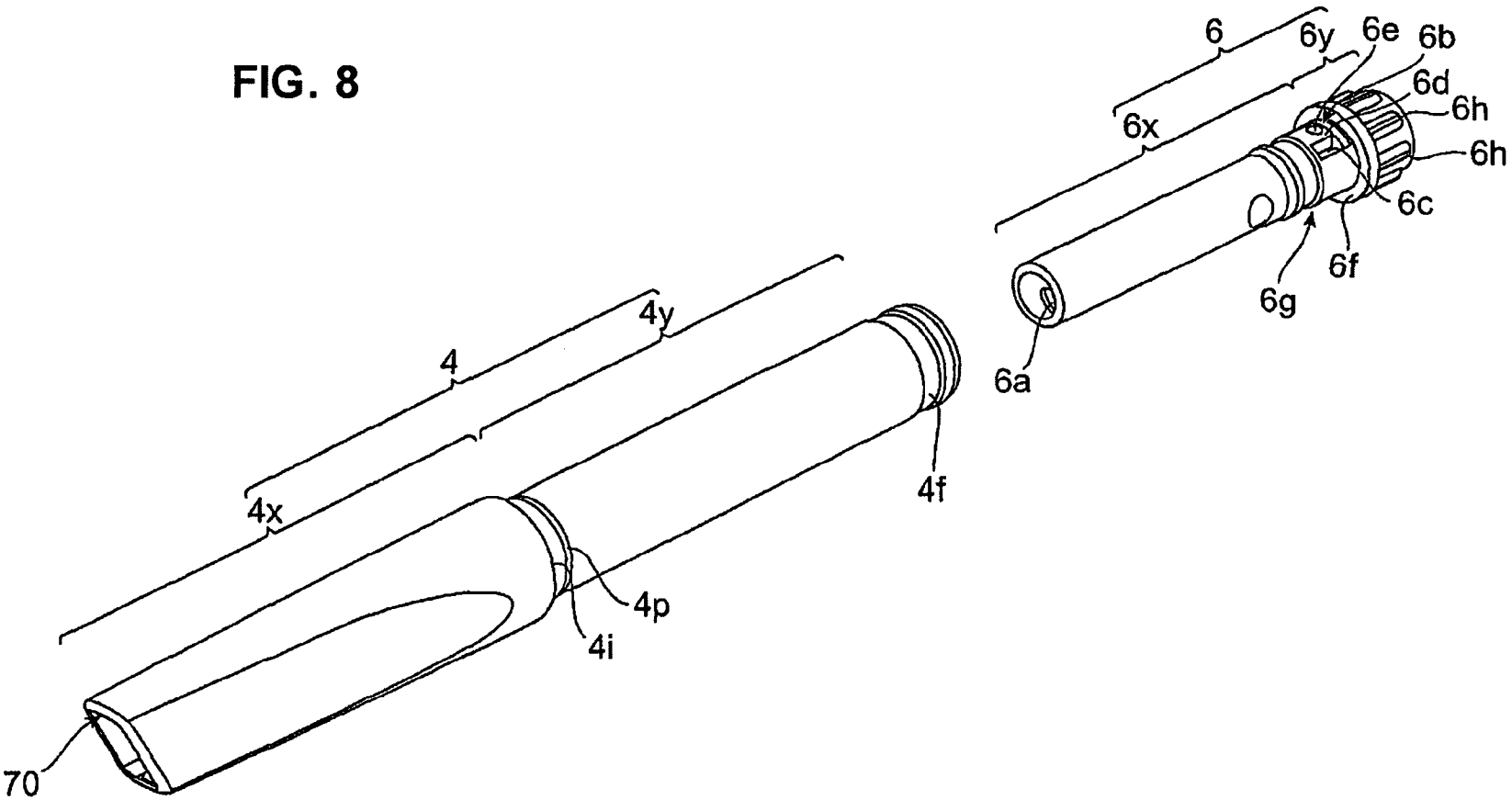
FIG. 8 is an exploded perspective view of a cartridge tube and a thread tube in FIG. 7.
Figure 9:
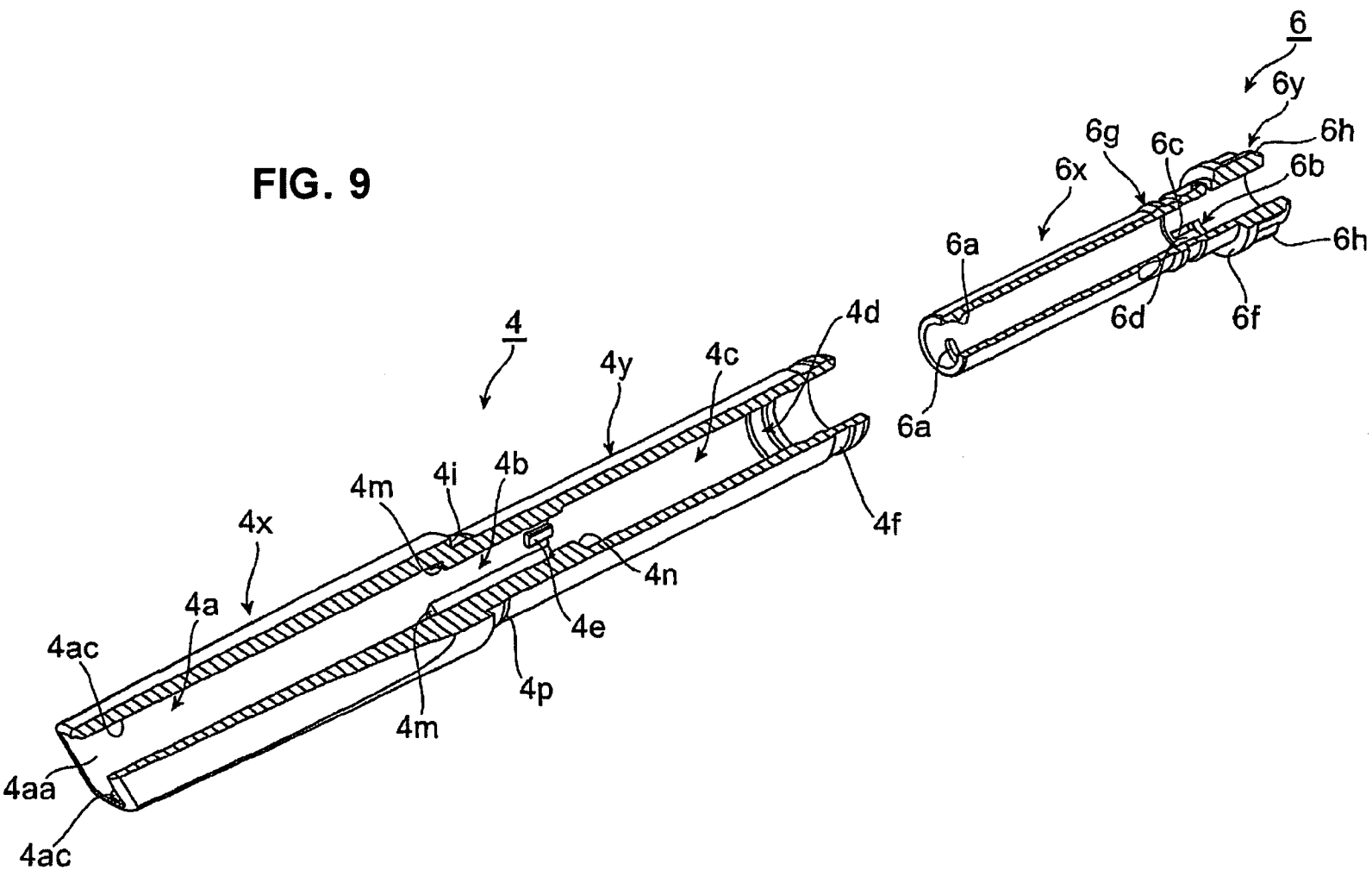
FIG. 9 is a broken exploded perspective view of the cartridge tube and the thread tube shown in FIG. 8.
Figure 10:
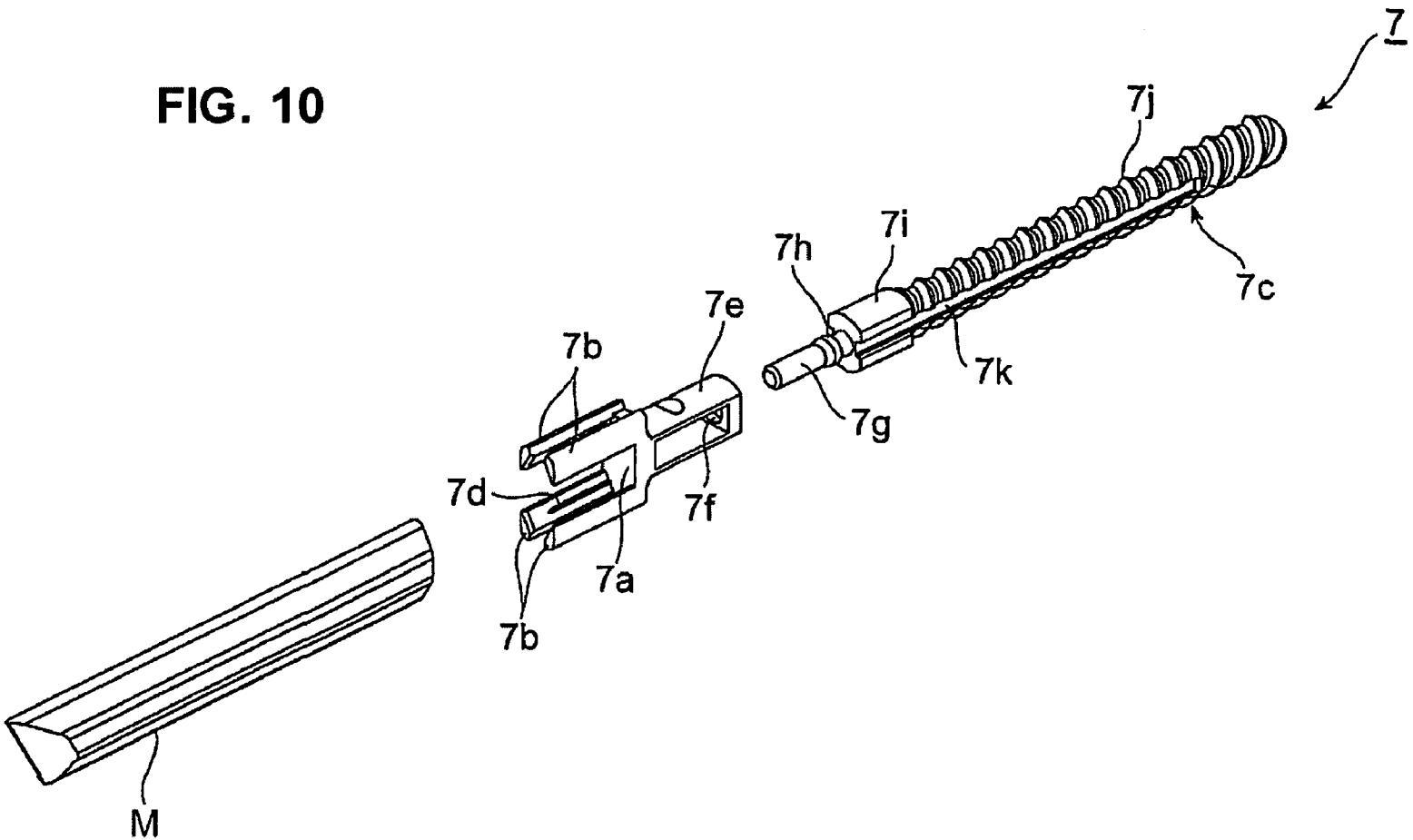
FIG. 10 is an exploded perspective view showing a stick-shaped cosmetic material support body and a stick-shaped cosmetic material in FIGS. 2 and 3.
Figure 11:
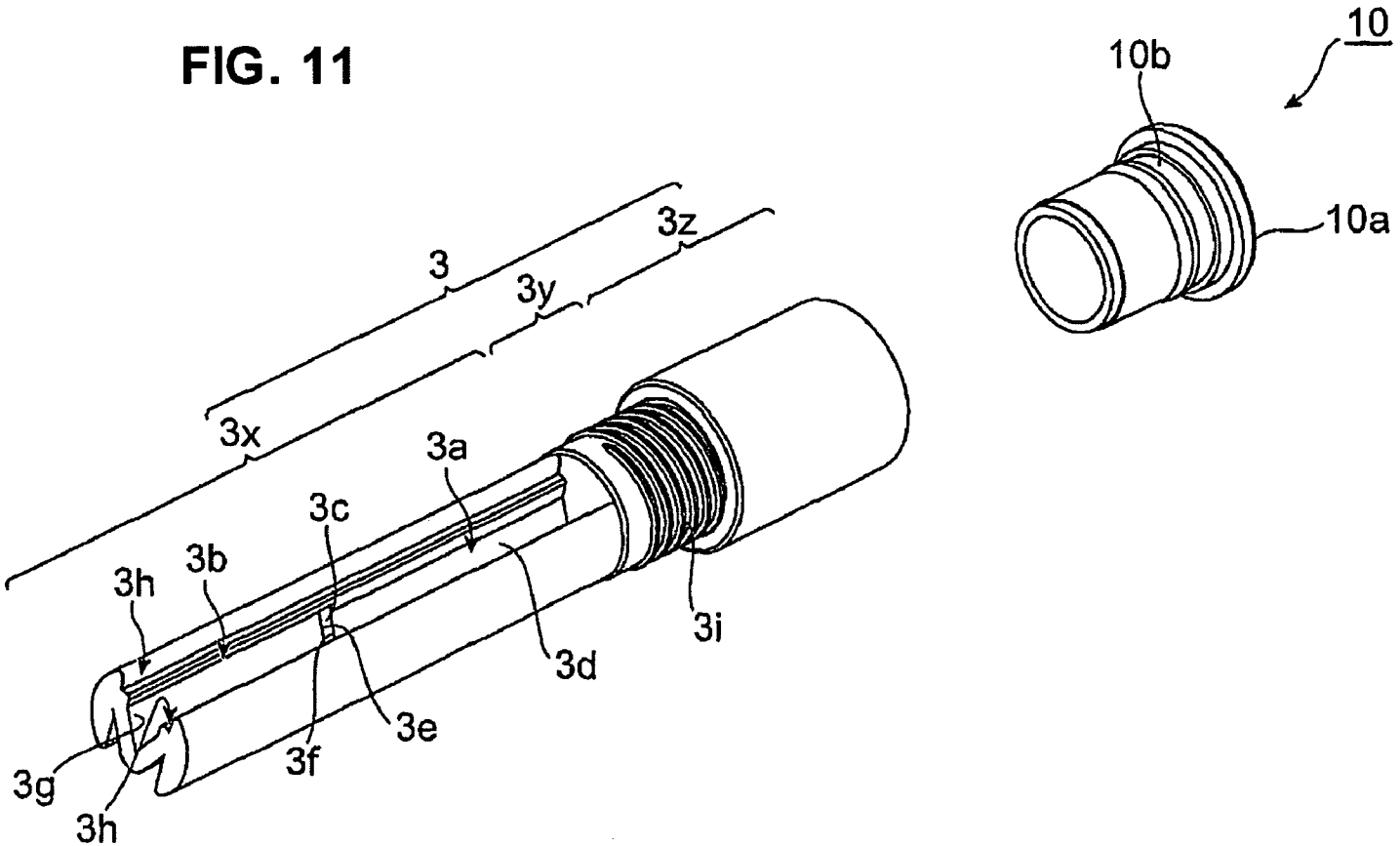
FIG. 11 is an exploded perspective view showing a stick-shaped cosmetic material sharpener and a tail valve in FIGS. 2 and 3.
Figure 12:
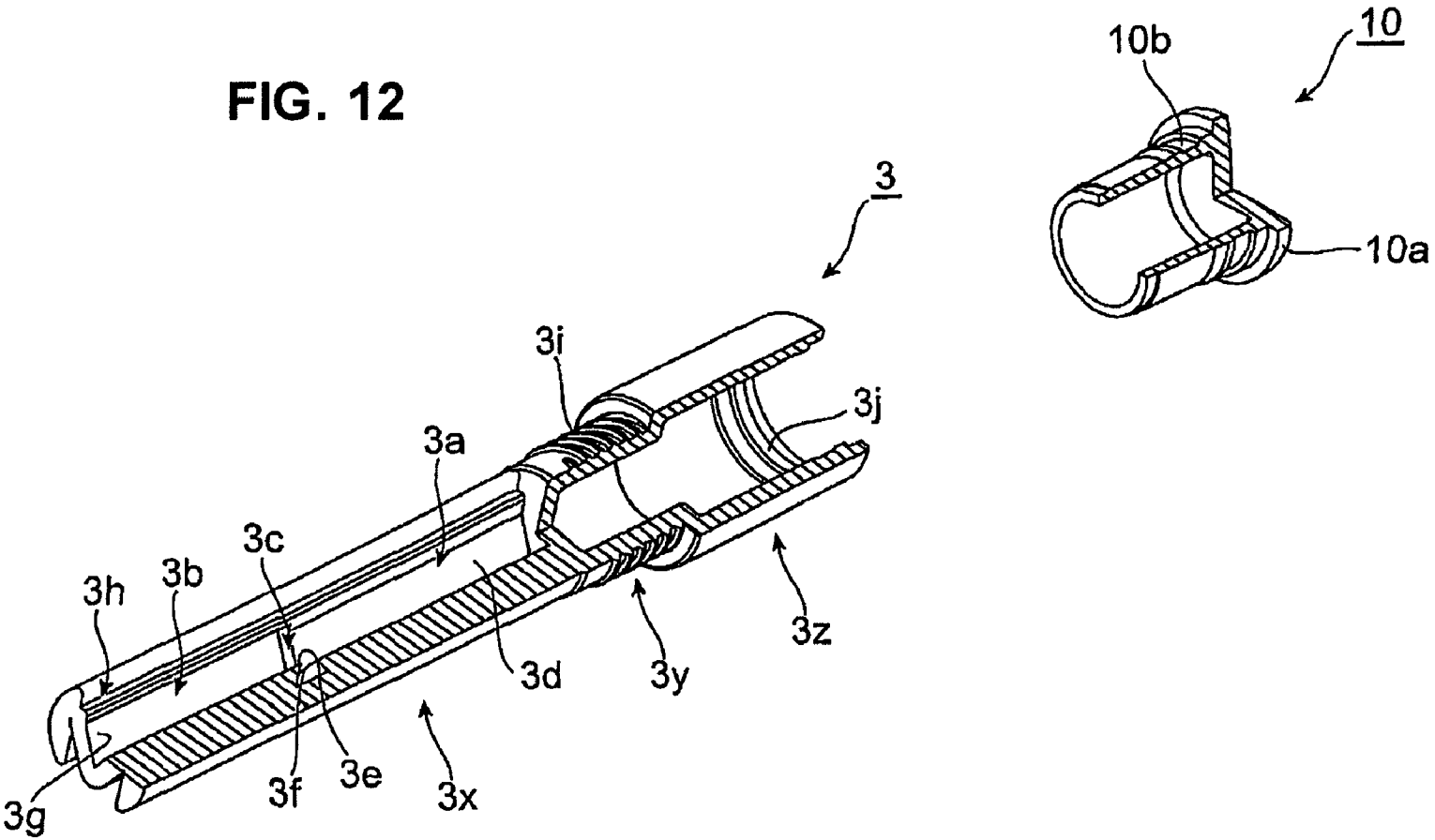
FIG. 12 is a broken exploded perspective view of the stick-shaped cosmetic material sharpener and the tail valve shown in FIG. 11.
Figure 13:
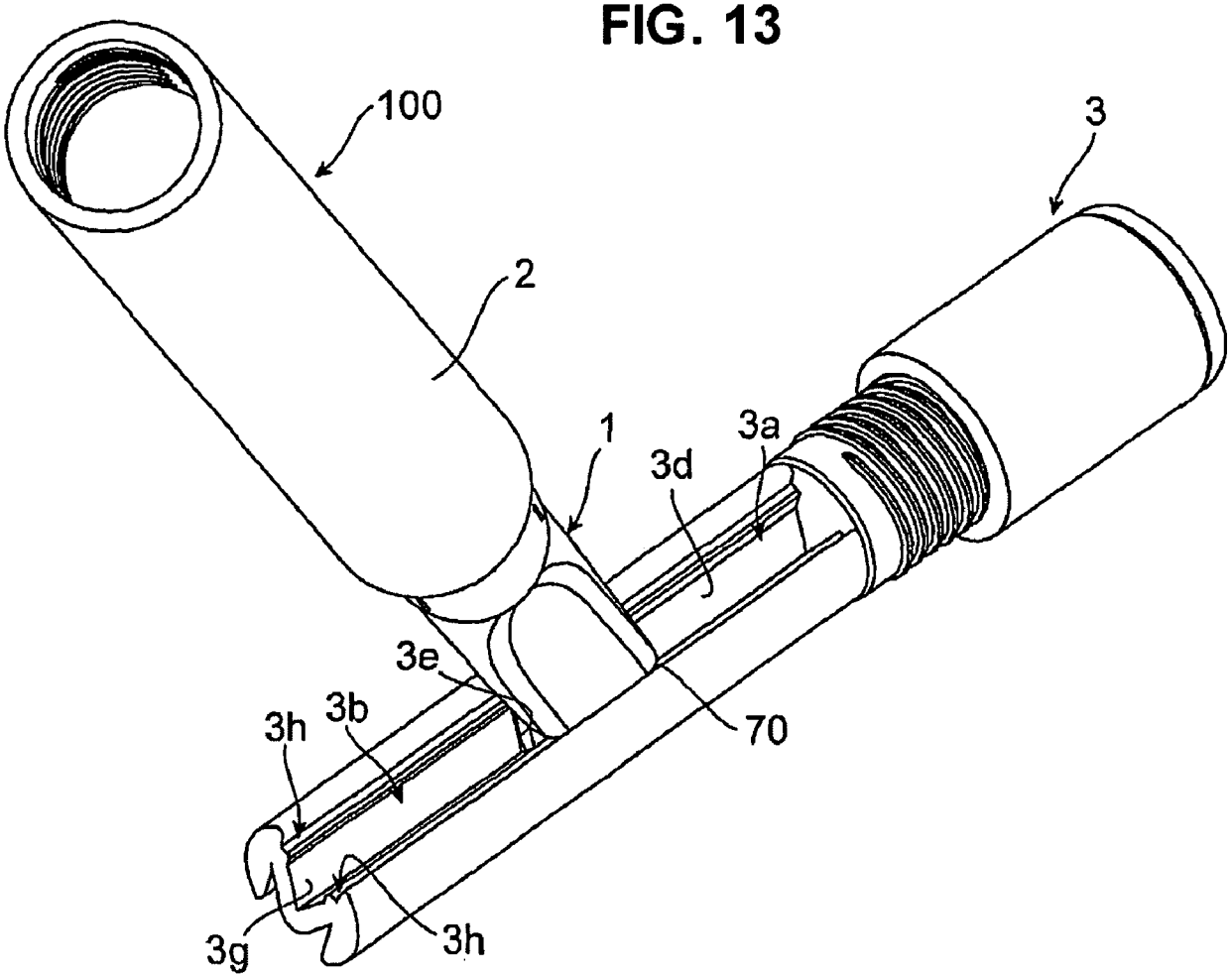
FIG. 13 is a perspective view showing a state at a time of sharpening a leading end portion of the stick-shaped cosmetic material by using the stick-shaped cosmetic material sharpener.
Figure 14:
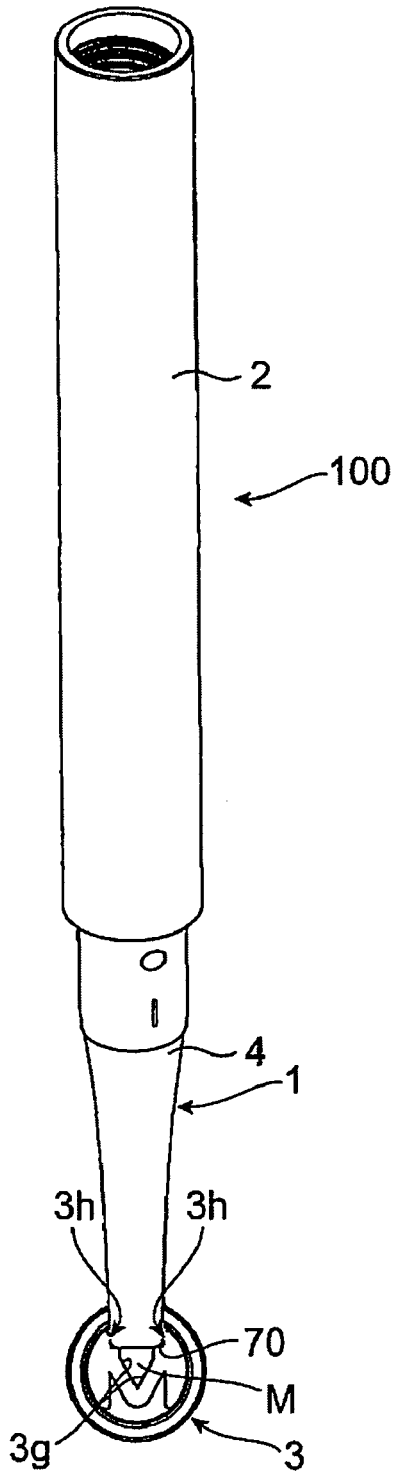
FIG. 14 is a front view showing a state at a time of sharpening the leading end portion of the stick-shaped cosmetic material by using the stick-shaped cosmetic material sharpener.
Figure 15:
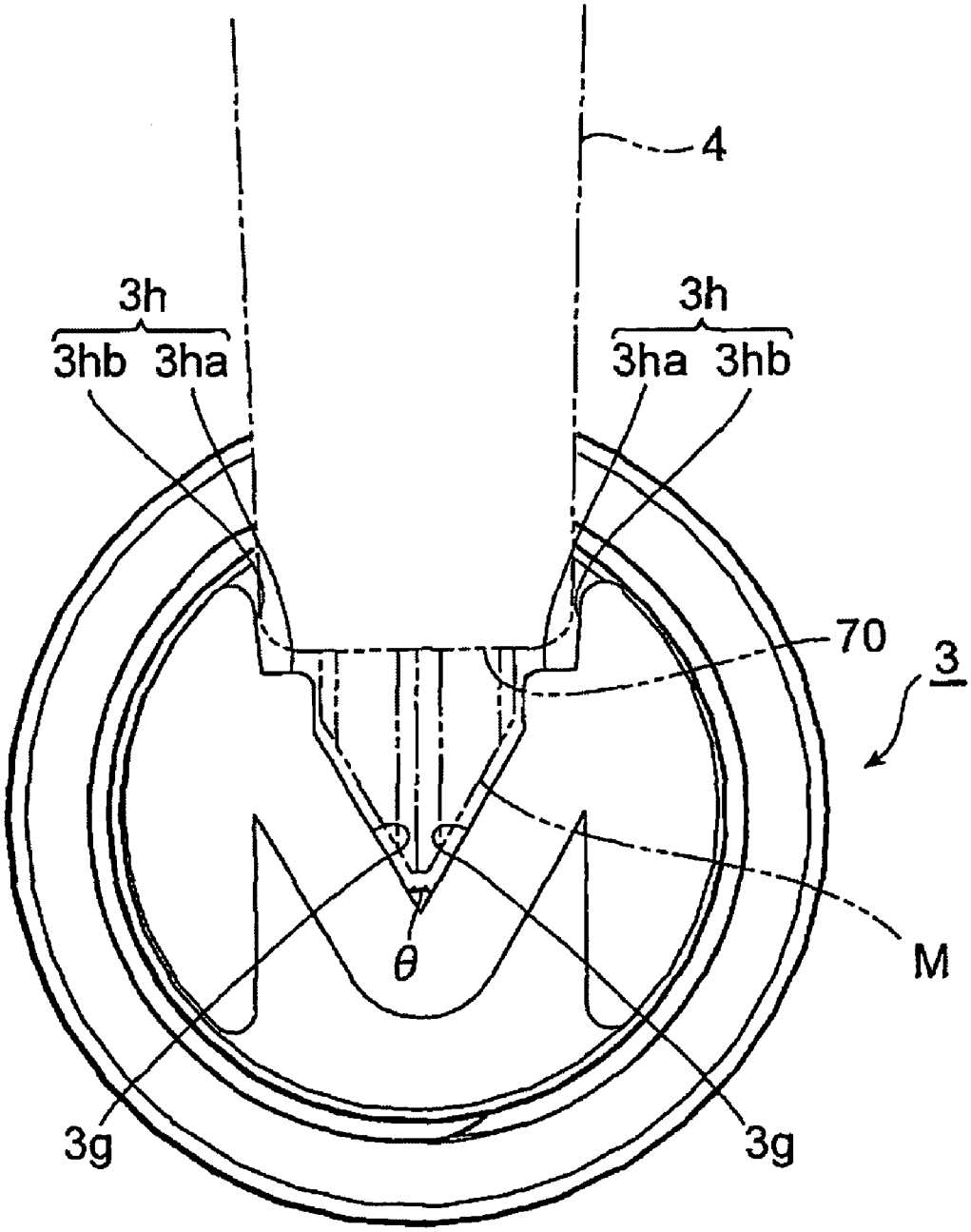
FIG. 15 is a front view showing a main portion in FIGS. 13 and 14 in an enlarged manner.
Figure 16:
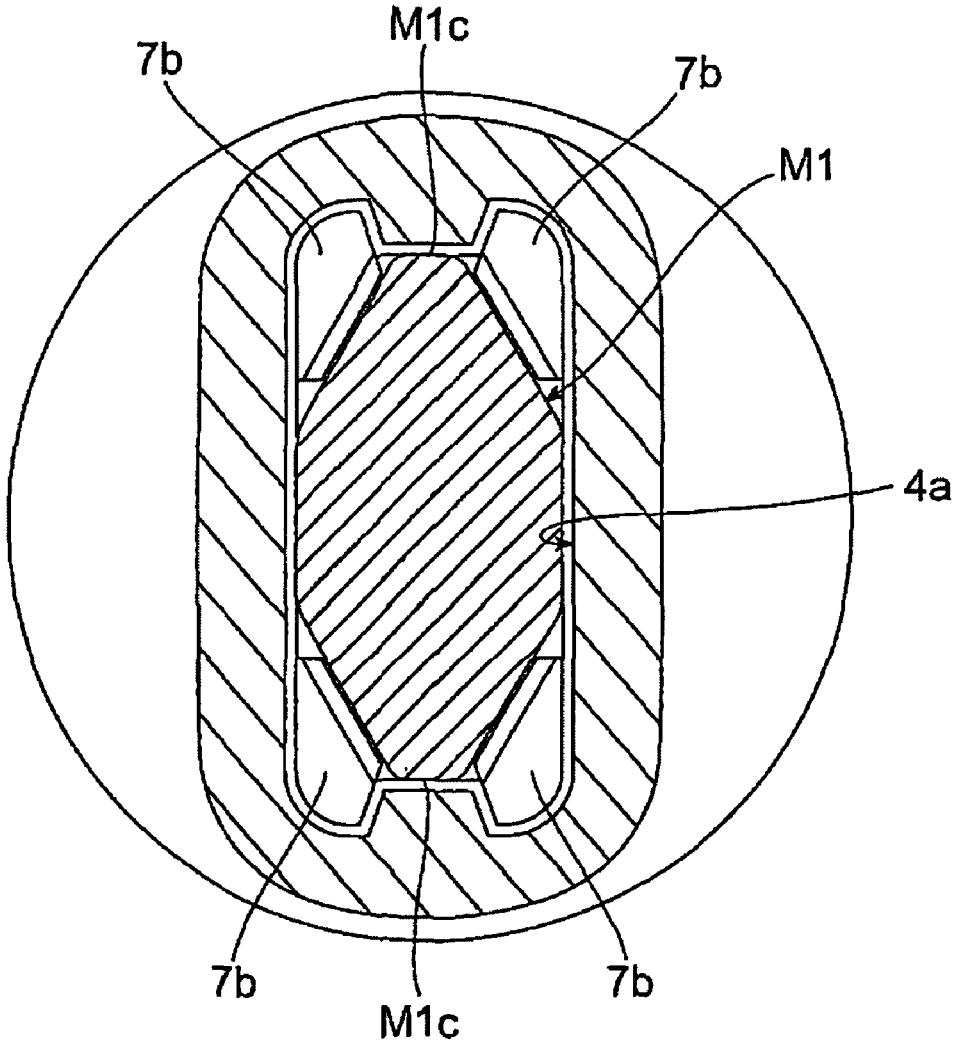
FIG. 16 is a cross sectional view showing a stick-shaped cosmetic material feeding container in accordance with a second embodiment of the present invention, and is a cross sectional view corresponding to FIG. 4.
Figure 17:
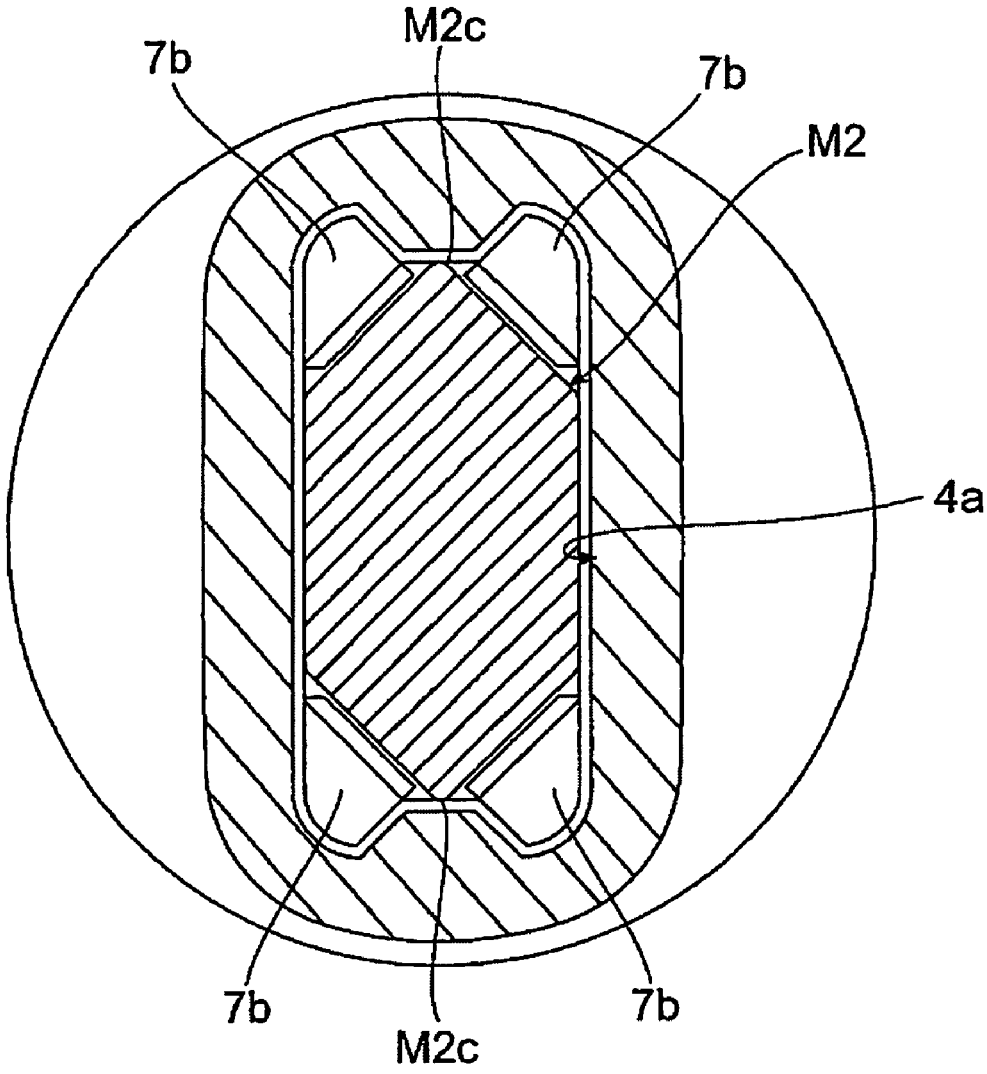
FIG. 17 is a cross sectional view showing a stick-shaped cosmetic material feeding container in accordance with a third embodiment of the present invention, and is a cross sectional view corresponding to FIG. 4.
Figure 18:
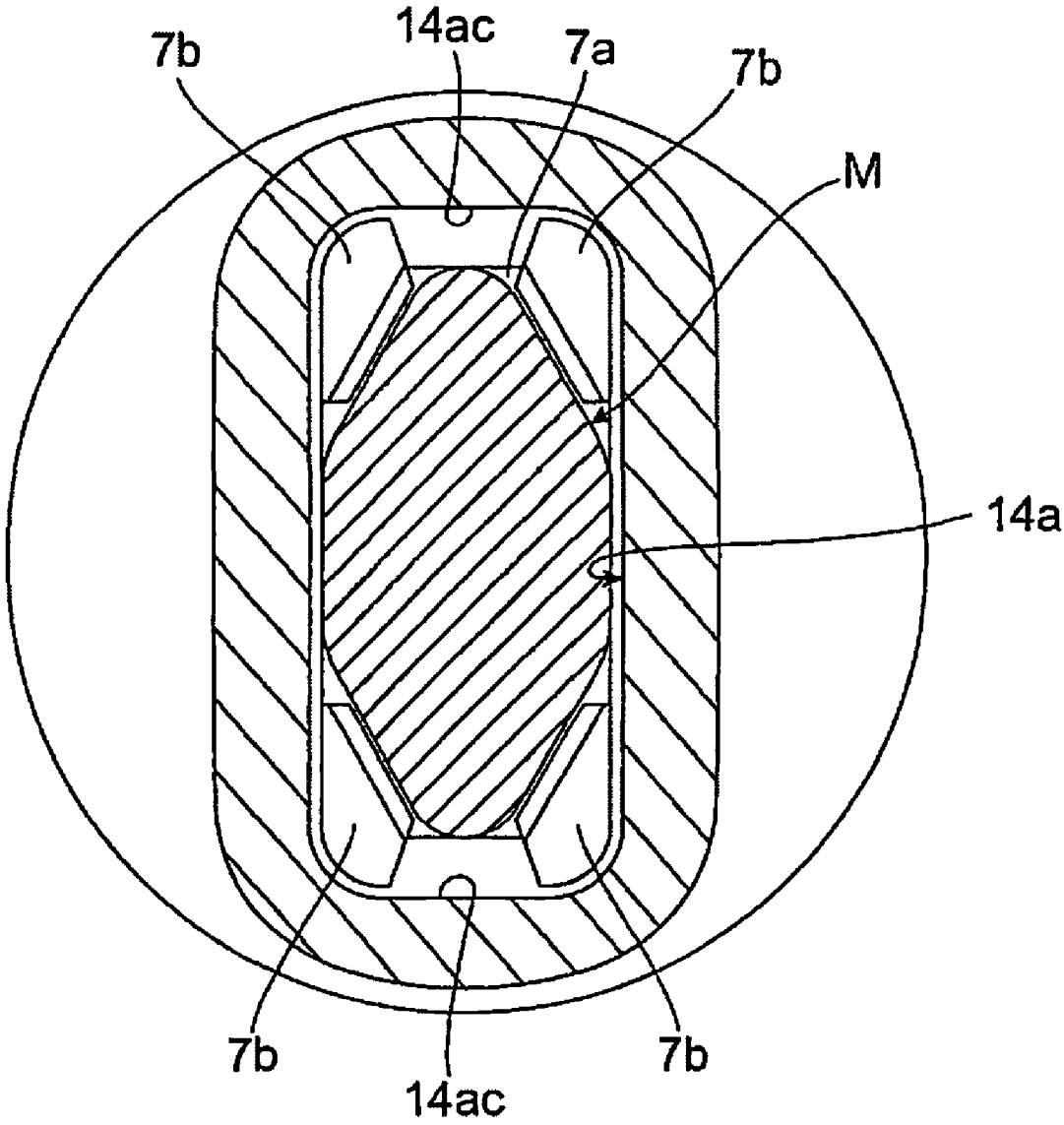
FIG. 18 is a cross sectional view showing a stick-shaped cosmetic material feeding container in accordance with a fourth embodiment of the present invention, and is a cross sectional view corresponding to FIG. 4.

FIGS. 1 to 15 show a first embodiment in accordance with the present invention, and FIGS. 16 to 18 show second to fourth embodiments in accordance with the present invention, respectively. A description will be first given of the first embodiment with reference to FIGS. 1 to 15. FIG. 1 is a perspective view showing an outer appearance of a stick-shaped cosmetic material feeding container in accordance with the first embodiment, FIGS. 2 to 4 are respective sectional views of the stick-shaped cosmetic material feeding container, FIGS. 5 and 6 are respective exploded perspective views showing a cartridge accommodating container and an inner device, FIG. 7 is a perspective view showing a stick-shaped cosmetic material cartridge, FIGS. 8 and 9 are respective exploded perspective views showing a cartridge tube and a thread tube, FIG. 10 is an exploded perspective view showing a stick-shaped cosmetic material support body and a stick-shaped cosmetic material, FIGS. 11 and 12 are respective exploded perspective views showing a stick-shaped cosmetic material sharpener and a tail valve, and FIGS. 13 to 15 are respective views showing a state at a time of sharpening a leading end portion of the stick-shaped cosmetic material by using the stick-shaped cosmetic material sharpener.

Figure 4:
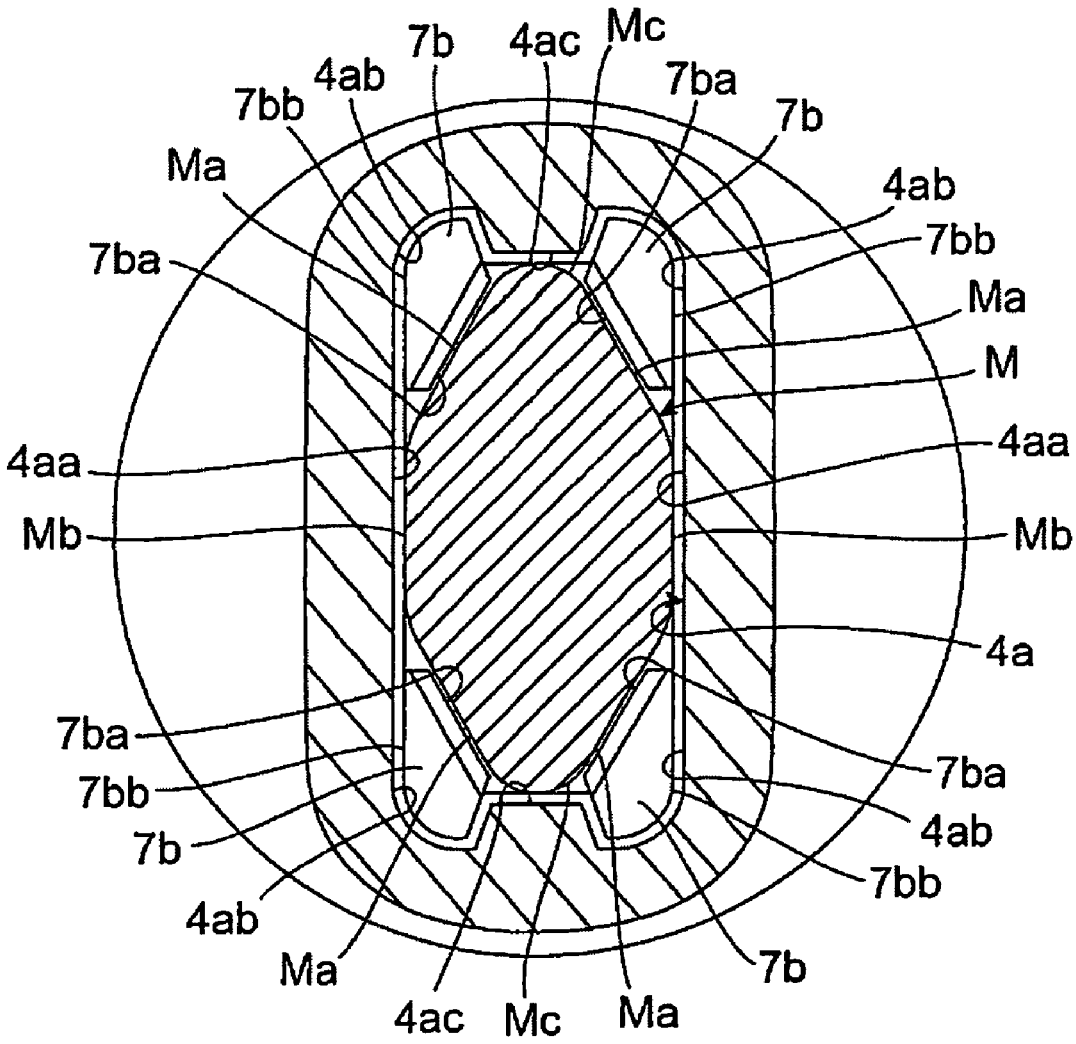
FIG. 4 is a view as seen along an arrow IV-IV in FIG. 2.

The stick-shaped cosmetic material used here is constituted by various solid stick-shaped cosmetic materials, for example, an eyeliner, an eyebrow, a lip liner, a concealer and the like, and is constituted by a stick-shaped cosmetic material M structured such that a cross sectional shape has a long diameter and a short diameter, and respective inclined surfaces Ma are provided between the long diameter and the short diameter, as shown in FIG. 4. In this case, the stick-shaped cosmetic material M is formed in a shape obtained by cutting corner portions of a rectangular cross sectional shape, and is structured such that outer peripheral surfaces Mb at a short diameter side are formed as parallel and flat surfaces, outer peripheral surfaces Mc at a long diameter side are formed as circular arc surfaces having a small roundness, and the inclined surfaces Ma are respectively positioned between the short diameter side outer peripheral surface Mb and the long diameter side outer peripheral surface Mc. Further, in this case, the leading end of the stick-shaped cosmetic material M is formed in an inclined shape with respect to a surface which is orthogonal to an axis as seen in a vertical direction to the paper surface of FIG. 2, as shown in FIG. 2.

As shown in FIG. 1, a stick-shaped cosmetic material feeding container 100 is structured such that a whole shape is formed in a round rod shape (a stick shape) like a writing instrument so as to have a good outer appearance. As shown in FIGS. 1 to 3, the stick-shaped cosmetic material feeding container 100 is detachably provided with a stick-shaped cosmetic material cartridge 1 accommodating the stick-shaped cosmetic material M mentioned above at one end side (a left side in the drawing) of a cartridge accommodating container 2, and is detachably provided with a stick-shaped material sharpener 3 at the other end side of the cartridge accommodating container 2, whereby in the case that a cartridge tube 4 and the cartridge accommodating container 2 constituting an outer shape of the stick-shaped cosmetic material cartridge 1 are relatively rotated by a user, the stick-shaped cosmetic material M is taken out and in from a leading end of the cartridge tube 4. In this case, the stick-shaped cosmetic material cartridge 1 can be covered by a detachable cap 9 as occasion demands as shown in FIGS. 2 and 3.

Figure 5:
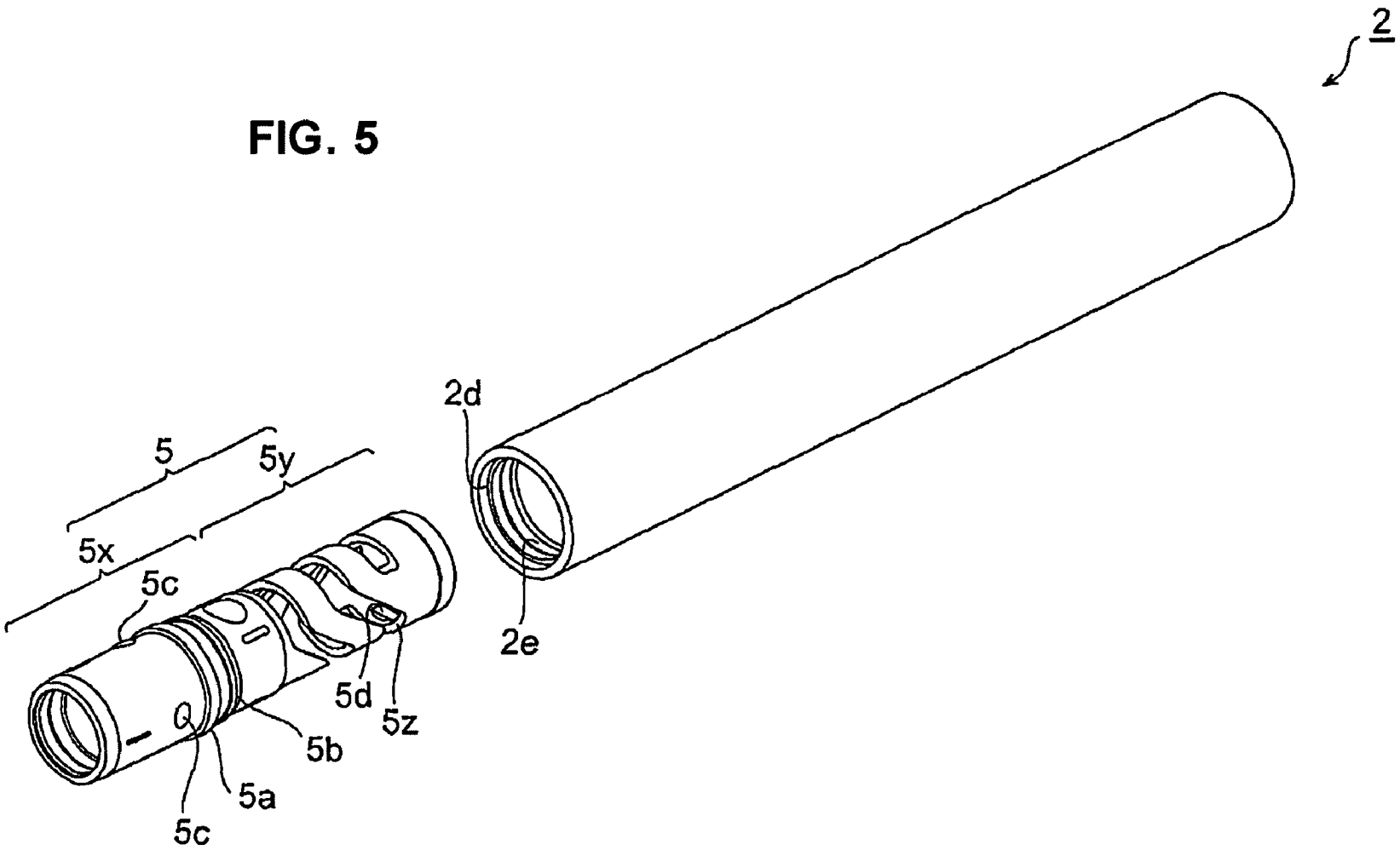
FIG. 5 is an exploded perspective view showing a cartridge accommodating container and an inner device in FIGS. 2 and 3.
Figure 6:
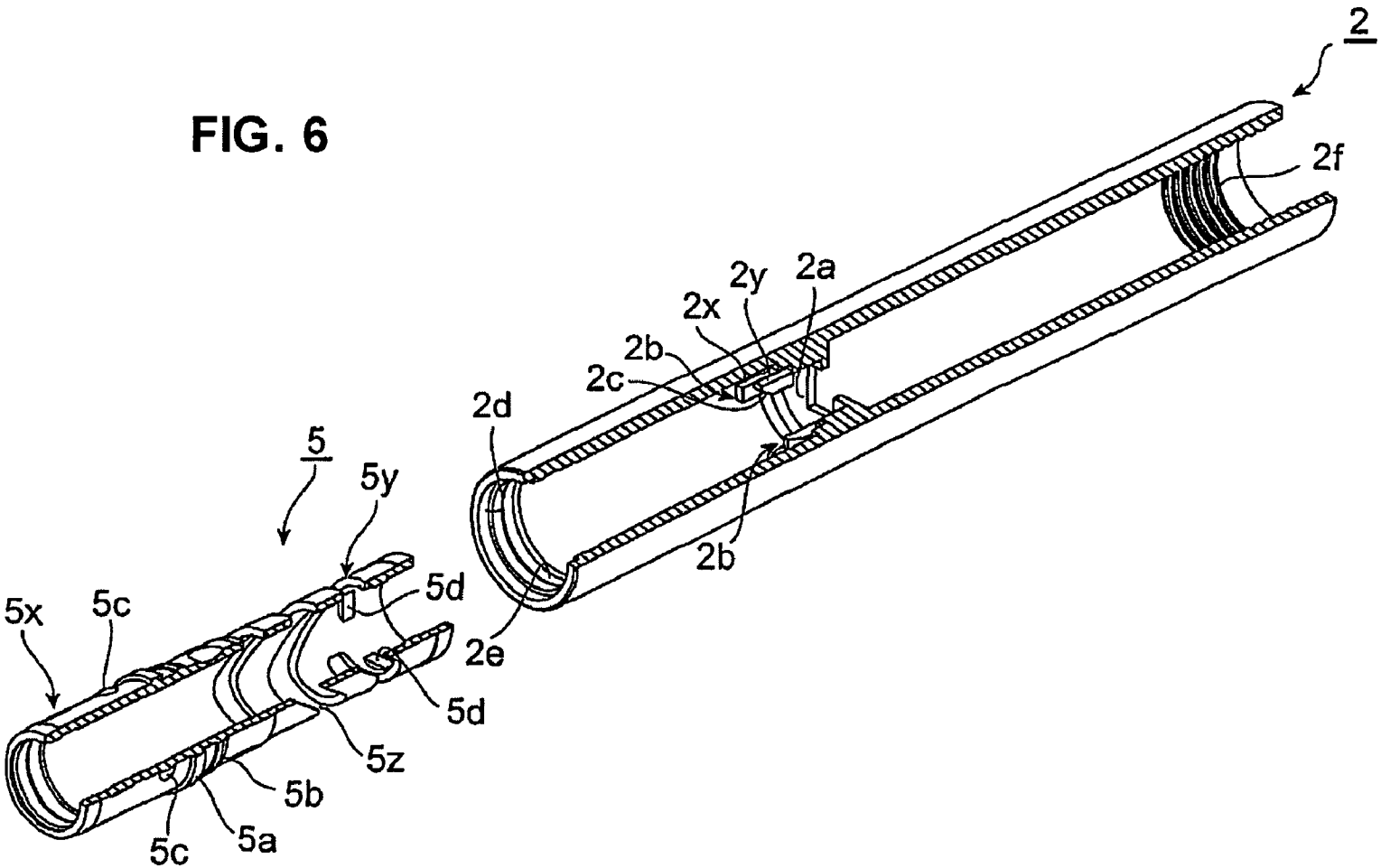
FIG. 6 is a broken exploded perspective view of the cartridge accommodating container and the inner device shown in FIG. 5.

The cartridge accommodating container 2 is structured in a cylindrical shape in which both ends are open, as shown in FIGS. 5 and 6. The cartridge accommodating container 2 is structured, as shown in FIG. 6, such that an approximately center position in an axial direction within a tube is comparted by a middle compartment 2*a*, a space accommodating a rear half portion of the stick-shaped cosmetic material cartridge 1 via an inner device 5 is defined within a tube at a left side in the drawing from the middle compartment 2*a*, and a space accommodating a rear half portion of the stick-shaped cosmetic material sharpener 3 is defined within a right tube.

A stepped rib 2*b* extending toward an opening at a leading end is provided at each of four uniformly arranged positions of a peripheral edge, at the stick-shaped cosmetic material cartridge 1 side (at a left side of the drawing) of the middle compartment 2*a* comparting both the spaces. The rib 2*b* is provided with a lower stage rib 2*x* for contacting a rear end surface of the inner device 5, and an upper stage rib 2*y* for engaging a thread tube 6 mentioned below of the stick-shaped cosmetic material cartridge 1 in a rotational direction. A leading end of the upper stage rib 2*y* is formed in a shape concaved to the middle compartment 2*a* side from the lower stage rib 2*x*, and is formed as an inclined surface 2*c* in which a leading end surface of the concave shape is inclined at 60 degree with respect to a peripheral direction.

Further, the cartridge accommodating container 2 is provided with a step hole 2*d*, which is formed somewhat larger than an inner diameter within the tube for accommodating an annular collar portion 5*a* mentioned below of the inner device 5 and, at an opening end at the stick-shaped cosmetic material cartridge 1 side, and is provided with an annular groove portion 2*e* for engaging the inner device 5 in an axial direction, at a position closer to a rear side in the axial direction than the step hole 2*d*. Further, the cartridge accommodating container 2 is provided with a female thread 2*f* for installing the stick-shaped cosmetic material sharpener 3, on an inner peripheral surface at an inner side than the opening end at the stick-shaped cosmetic material sharpener 3 side (at a right side in the drawing).

The inner device 5 is formed as an injection molded product with a resin, and is formed in an approximately cylindrical shape provided with a spring portion 5*y* at a rear half portion, and a main body portion 5*x* at a front side than the spring portion 5*y*, as shown in FIGS. 5 and 6.

The main body portion 5*x* is provided with an annular collar portion 5*a*, in which an outer peripheral surface in the middle in the axial direction is enlarged in a diametrical direction, as a structure which is accommodated in the step hole 2*d* of the cartridge accommodating container 2, and is provided with an annular protruding portion 5*b* as a structure engaging with the annular groove 2*e* of the cartridge accommodating container 2 in the axial direction, on an outer peripheral surface at a rear side than the annular collar portion 5*a*. Further, a plurality of protruding portions 5*c* (so-called dowels) for engaging the cap 9 shown in FIG. 2 detachably in an axial direction are provided along a peripheral direction, on an outer peripheral surface at a front side than the annular collar portion 5*a* of the main body portion 5*x*.

The spring portion 5*y* is constituted by a so-called resin spring which is integrally provided at a rear side of the main body portion 5*x*, and is provided with a notch hole 5*z* formed by notching a slit in a spiral shape so as to freely expand and contract in the axial direction. The spring portion 5*y* can vary its strength on the basis of a shape of the notch hole 5*z*. Further, a plurality of protruding portions 5*d* for detachably engaging the cartridge tube 4 in the axial direction are provided along the peripheral direction, on the inner peripheral surface of the rear end portion of the spring portion 5*y*.

Further, the inner device 5 provided with the main body portion 5*x* and the spring portion 5*y* is structured such that the spring portion 5*y* is made to freely expand and contract in the axial direction by the notch hole 5*z* so as to have a shock absorbing property, and the notch hole 5*z* is compressed to the leading end side and the rear portion side including the notch hole 5*z* is moved to the leading end side, in the case that external force toward the leading end side is applied to the rear end side of the spring portion 5*y*.

The inner device 5 is structured, as shown in FIGS. 2 and 3, such that the rear side portion than the annular collar portion 5*a* is inserted into the cartridge accommodating container 2, and the annular collar portion 5*a* is contacted to the step hole 2*d* of the cartridge accommodating container 2 so as to be accommodated. Further, the rear end surface of the spring portion 5*y* is brought into contact with the lib 2*x* of the lower stage of the cartridge accommodating container 2, the annular protruding portion 5*b* is engaged with the annular groove portion 2*e* of the cartridge accommodating container 2 in the axial direction, and the outer peripheral surface of the main body portion 5*x* is adhered to the inner peripheral surface of the cartridge accommodating container 2, whereby the inner device 5 is installed to the cartridge accommodating container 2 so as to be synchronously rotatable and undetachable in the axial direction.

The stick-shaped cosmetic material cartridge 1 is approximately structured such as to have the cartridge tube 4 formed in the stepped tube shape as an outer shape structure, as shown in FIG. 7, and accommodate the stick-shaped cosmetic material M, a stick-shaped cosmetic material support body 7 supporting the stick-shaped cosmetic material M, and a thread tube 6 constructing an engagement mechanism within the cartridge tube 4, as shown in FIGS. 2 and 3.

As shown in FIGS. 2, 8 and 9, the cartridge tube 4 is provided with an outer diameter large-diameter portion 4*x* serving as a grip portion at a front half side protruding from the inner device 5 of the cartridge accommodating container 2, and an outer diameter small-diameter portion 4*y* at a rear half side connected to a rear end of the outer diameter large-diameter portion 4*x* via a step surface 4*i*, as shown in FIGS. 8 and 9.

The outer diameter large-diameter portion 4*x* is structured such that an outer surface from the step surface 4*i* to a portion near the step portion 4*i* is structured in a circular shape, and an outer surface (a surface in a vertical direction to the paper surface of FIG. 2; a surface in a vertical direction in FIG. 3) from the circular outer surface to a leading end, that is, the outer surface corresponding to the outer peripheral surface Mb at the short diameter side of the accommodated stick-shaped cosmetic material M is formed as an outer surface which is gradually tapered toward the leading end. Further, a leading end surface 70 of the outer diameter large-diameter portion 4*x* is formed approximately in a rectangular shape as seen from a front surface (as seen from the left side of the drawing), as shown in FIG. 8. Further, in this case, the leading end surface 70 of the outer diameter large-diameter portion 4*x* is formed as an inclined surface which is inclined with respect to a surface being orthogonal to the axis as seen from a vertical direction to the paper surface of FIG. 2, as shown in FIG. 2.

As shown in FIGS. 8 and 9, the outer diameter small-diameter portion 4*y* is formed approximately in a cylindrical shape, and is made smaller than an inner diameter of the cartridge accommodating container 2 so as to be freely inserted.

A tube hole passing through the cartridge tube 4 in the axial direction is provided with an intermediate region 4*b* in a middle in the axial direction thereof, as shown in FIGS. 2, 3 and 9, a range from the leading end to a leading end of the intermediate region 4*b* is formed as a forward and backward moving hole 4*a* which accommodates the stick-shaped cosmetic material M and a support piece 7*b* mentioned below supporting the stick-shaped cosmetic material M, and in which these elements move forward and backward, and a range from a rear end of the intermediate region 4*b* to a tube rear end is formed as a thread tube accommodating hole 4*c* accommodating the thread tube 6.

The forward and backward moving hole 4*a* is formed in such a cross sectional shape as to have a long diameter and a short diameter as shown in FIGS. 2 to 4, has short diameter side inner peripheral surfaces 4*aa* which are in parallel and flat, at the short diameter side as shown in FIG. 4, and is structured such that inner peripheral surfaces 4*ab* at four corners (inner peripheral surfaces at the support piece 7*b* side; the support piece 7*b* is described later) do not protrude to an outer side in a short diameter direction (a lateral direction in the drawing) from the short diameter side inner peripheral surface 4*aa*. In this case, the forward and backward moving hole 4*a* is formed approximately in a rectangular cross sectional shape, and is structured such that a long diameter side peripheral wall constituting the forward and backward moving hole 4*a* is protruded to an inner side, and an inner peripheral surface 4*ac* at a long diameter side of the forward and backward moving hole 4*a* constitutes a leading end surface of the convex portion and is formed as a flat surface, as shown in FIGS. 4 and 9.

As shown in FIGS. 2, 3 and 9, the thread tube accommodating hole 4*c* is formed approximately in a circular cross sectional shape, and an inner diameter thereof is made smaller than a long diameter of the forward and backward moving hole 4*a*. In the thread tube accommodating hole 4*c*, as shown in FIG. 9, an annular concavo-convex portion (in which concave and convex portions are arranged in the axial direction) 4*d* for engaging the thread tube 6 in the axial direction is formed at a position close to the rear end.

The intermediate region 4*b* is structured such as to be connected to the rear end at the long diameter side of the forward and backward moving hole 4*a* via a step surface 4*m* in such a manner that an inner periphery is made small in diameter (connected at the short diameter side in the same diameter), as shown in FIGS. 2, 3 and 9, and be connected to the leading end of the thread tube accommodating hole 4*c* via a step surface 4*n* in such a manner that the inner periphery is made small in diameter, thereby being formed as a non-circular hole. The step surface 4*m* at a boundary portion between the intermediate region 4*b* and the forward and backward moving hole 4*a* serves as a backward woving limit with which a rear end surface of a support piece 7*b* of the stick-shaped cosmetic material support body 7 is brought into contact at a time when the stick-shaped cosmetic material support body 7 is moved backward.

Further, the intermediate region 4*b* is provided with an engagement piece 4*e* extending in the axial direction; as a rotation preventer constructing one side of rotation preventing portion (rotation preventing mechanism) 60 of the stick-shaped cosmetic material support body 7, as shown in FIGS. 3 and 9. The engagement piece 4*e* serves as a forward moving limit with which a rear end surface of a concave groove 7*k* (described below) of the stick-shaped cosmetic material support body 7 is brought into contact at a time when the stick-shaped cosmetic material support body 7 moves forward.

Further, an annular groove portion 4*f* is provided as a structure of being detachably engaged with the protruding portion 5*d* of the spring portion 5*y* of the inner device 5 in the axial direction, as shown in FIGS. 8 and 9, on an outer peripheral surface of a rear end portion of the cartridge tube 4.

Further, an annular groove 4*p* is provided on an outer peripheral surface close to the step surface 4*i* of the outer diameter small-diameter portion 4*y* of the cartridge tube 4, and an O-ring 8 is installed to the annular groove 4*p*, as shown in FIGS. 2 and 3. The O-ring 8 is elastically brought into contact with the inner device 5, and is provided for applying a good rotational resistance between the cartridge tube 4 and the inner device 5 and preventing a rattling motion in the diametrical direction.

The thread tube 6 is formed approximately in a cylindrical shape, as shown in FIGS. 8 and 9, and is formed by integrally molding a main body portion 6*x*, and a gear portion 6*y* connected to a rear end of the main body portion 6*x* via a step surface 6*f* in such a manner that an outer peripheral surface is made large in diameter, for example, with a flexible material such as a synthetic resin or the like.

The thread tube 6 is provided with an engagement projection 6*a* serving as a female thread constituting one side of engagement portion (engagement mechanism) 50 at each of positions close to a leading end of an inner peripheral surface thereof, the positions being symmetrical at 180 degree with respect to the axis.

Further, the thread tube 6 is provided with elastic engagement portions 6*b* and 6*b* at symmetrical positions at 180 degree with respect to the axis at positions close to the gear portion 6*y* of the main body portion 6*x*. The elastic engagement portion 6*b* is formed by a C-shaped slot 6*c* provided in the peripheral wall of the main body portion 6*x* of the thread tube 6, and is provided with a peninsular portion 6*d* serving as a leaf spring in accordance with a flexibility of the synthetic resin or the like corresponding to the molding material, and a protruding portion 6*e* protruding from an outer peripheral surface of the peninsular portion 6*d*. The protruding portion 6*e* is elastically brought into contact with an inner peripheral surface of the cartridge tube 4, as shown in FIG. 2, and is provided for applying a good rotational resistance to a portion between the cartridge tube 4 and the thread tube 6, and preventing the rattling motion in the diametrical direction.

Further, as shown in FIGS. 8 and 9, an annular concavo-convex portion (in which concave and convex portions are arranged in the axial direction) 6*g* is provided as a structure engaging with the annular concavo-convex portion 4*d* of the cartridge tube 4 in the axial direction, at an outer peripheral position close to the elastic engagement portion 6*b* of the main body portion 6*x*.

Further, an outer peripheral surface of the gear portion 6*y* of the thread tube 6 is provided with a rib 6*h* having a chevron cross sectional shape and extending along the axial direction as a structure engaging with the rib 2*y* at an upper stage of the cartridge accommodating container 2 in a rotating direction, at eight uniformly arranged positions.

The thread tube 6 is inserted into the thread tube accommodating hole 4*c* of the cartridge tube 4, as shown in FIGS. 2 and 3. Its step surface 6*f* is contacted to the rear end surface of the cartridge tube 4, the protruding portion 6*e* of the peninsula portion 6*d* is brought into contact with the inner peripheral surface of the cartridge tube 4, and the annular concavo-convex portion 6*g* is engaged with the annular concavo-convex portion 4*d* of the cartridge tube 4 in the axial direction, whereby the thread tube 6 is installed to the cartridge tube 4 so as to be relatively rotatable and be undetachable in the axial direction.

The stick-shaped cosmetic material support body 7 is formed, for example, by a flexible material such as a synthetic resin or the like, and is integrally provided with a base portion 7*a* for contacting the rear end surface of the stick-shaped cosmetic material M, and four pieces of support pieces 7*b* for supporting the rear end portion of the stick-shaped cosmetic material M contacted to the base portion 7*a*, and is further provided with a shaft body portion 7*c* extending rearward at a rear side of the base portion 7*a*, as shown in FIGS. 2, 3 and 10.

As shown in FIG. 10, the base portion 7*a* is formed in a shape which approximately conforms with a cross sectional shape of the stick-shaped cosmetic material M in a front view, and is provided with each of support pieces 7*b* protruding frontward between an outer peripheral surface in a short diameter side and an outer peripheral surface in a long diameter side.

As shown in FIG. 4, an inner peripheral surface 7*ba* of the support piece 7*b* is formed as an inclined surface corresponding to the inclined surface Ma of the stick-shaped cosmetic material M, and an outer peripheral surface 7*bb* at an outer side in the short diameter direction of the support piece 7*b* is structured such as not to protrude to an outer side in the short diameter direction than the outer peripheral surface at the short diameter side of the base portion 7*a* (the outer peripheral surface Mb at the short diameter side of the stick-shaped cosmetic material M). In this case, the outer peripheral surface 7*bb* at the outer side in the short diameter direction of the support piece 7*b* is approximately made flush with the outer peripheral surface at the short diameter side of the base portion 7*a* (the outer peripheral surface Mb at the short diameter side of the stick-shaped cosmetic material M). Further, an outer peripheral surface at an outer side in a long diameter direction of the support piece 7*b* is structured such as to protrude outward in the long diameter direction than the outer peripheral surface at the long diameter side of the base portion 7*a* (an outer peripheral surface Mc at the long diameter side of the stick-shaped cosmetic material M). Further, the support pieces 7*b* respectively support the inclined surfaces Ma of the stick-shaped cosmetic material M.

In this case, an inner surface of each of the support pieces 7*b* is provided with a protrusion 7*d* extending in the axial direction, as shown in FIG. 10. The protrusion 7*d* is provided for increasing a contact area with the stick-shaped cosmetic material M so as to increase a friction resistance by eating into the outer peripheral surface of the fitly inserted stick-shaped cosmetic material M, and inhibiting the stick-shaped cosmetic material M from rotating.

Further, the base portion 7*a* is provided with a coupling tube portion 7*e* which extends short toward a rear side and in which a cross sectional shape of the extending portion is formed in a shape obtained by shortening the long diameter side portion of the cross sectional shape of the stick-shaped cosmetic material M, in a rear end of the base portion 7*a*. The coupling tube portion 7*e* is structured in a closed-end tubular shape, and a small-diameter opening 7*f* is opened at a closed-end portion in a rear end. A surface around a front side of the opening 7*f* in the closed-end portion is provided for inhibiting the shaft body portion 7*c* from moving rearward, and a surface around a rear side of the opening 7*f* in the closed-end portion is provided for inhibiting the shaft body portion 7*c* from moving frontward.

The shaft body portion 7*c* is provided with a small-diameter shaft 7*g* at a leading end, and a small-diameter annular protruding portion 7*h* is provided as a structure engaging with the surface around the front side of the opening 7*f* in the closed-end portion in the axial direction, on an outer periphery of the small-diameter shaft 7*g*. Further, a large-diameter annular collar portion 7*i* is provided as a structure engaging with the surface around the rear side of the opening 7*f* in the closed-end portion in the axial direction, near a rear side than the annular protruding portion 7*h* of the shaft body portion 7*c*. Further, a shaft portion at a rear side than the annular collar portion 7*i* of the shaft body portion 7*c* is made smaller in diameter than the annular collar portion 7*i*, and is structured such as to be provided with a male thread 7*j* constructing the other side of the engagement portion (the engagement mechanism) 50. Further, a concave groove 7*k* serving as a rotation prevention constructing the other side of the rotation preventing portion (the rotation preventing mechanism) 60 of the stick-shaped cosmetic material support body 7 is provided at each of symmetrical positions at 180 degree with respect to the axis, from a leading end of the annular collar portion 7*i* of the shaft body portion 7*c* to a portion near the rear end portion of the shaft body portion 7*c*.

The shaft body portion 7*c* is structured, as shown in FIGS. 2 and 3, such that the small-diameter shaft 7*g* is inserted through the opening 7*f* of the coupling tube portion 7*e* of the base portion 7*a*, the annular protruding portion 7*h* enters into the coupling tube portion 7*e*, the rear end surface of the annular protruding portion 7*h* of the shaft body portion 7*c* faces to the surface around the front side of the opening 7*f* in the closed-end portion, and the leading end surface of the annular collar portion 7*i* of the shaft body portion 7*c* faces to the surface around the rear side of the opening 7*f* in the closed-end portion, whereby the shaft body portion 7*c* is installed to the base portion 7*a* so as to be relatively rotatable and be immovable in the axial direction. In this case, the base portion 7*a* and the shaft body portion 7*c* may be structured such as to be synchronously movable.

Further, in the stick-shaped cosmetic material support body 7, the shaft body 7*c* is inserted into the thread tube 6, and the male thread 7*j* is engaged with the thread projection 6*a* of the thread tube 6, whereby the engagement portion 50 is constructed. Further, as shown in FIG. 3, the engagement piece 4*e* of the intermediate region 4*b* of the cartridge tube 4 enters into the concave groove 7*k* so as to be engaged in the rotating direction, whereby the rotation preventing portion 60 of the stick-shaped cosmetic material support body 7 is constructed, and the base portion 7*a*, the support piece 7*b* and the stick-shaped cosmetic material M are inserted into the forward and backward moving hole 4*a* of the cartridge tube 4 to be in an entered state.

In this state, as shown in FIG. 4, there is formed a state in which the short diameter side inner peripheral surfaces 4*aa* of the forward and backward moving hole 4*a* come close to the short diameter side outer peripheral surfaces Mb of the stick-shaped cosmetic material M, the inner peripheral surfaces (the inner peripheral surfaces in four corners) 4*ab* at the support piece 7*b* side of the forward and backward moving hole 4*a* come close to the outer peripheral surfaces of the support pieces 7*b*, and the long diameter side inner peripheral surfaces (the convex surfaces) 4*ac* of the forward and backward moving hole 4*a* come close to the outer peripheral surfaces Mc at the long diameter side of the stick-shaped cosmetic material M.

Next, a description will be given of an assembling procedure of the stick-shaped cosmetic material cartridge 1 having the structure mentioned above. In this case, in the present embodiment, since the long diameter of the forward and backward moving hole 4*a* is made larger than the outer diameter of the thread tube 6 as shown in FIG. 2 so as to be applied to the stick-shaped cosmetic material M which is made comparatively larger in diameter in the long diameter direction, the base portion 7*a* of the stick-shaped cosmetic material support body 7 is inserted from the opening (the leading end of the forward and backward moving hole 4*a*) at the leading end of the cartridge tube 4.

Accordingly, the shaft body portion 7*c* constructing the stick-shaped cosmetic material support body 7 is first engaged with the thread tube 6, and the thread tube 6 with which the shaft body portion 7*c* is engaged is next inserted into the opening at the rear end of the cartridge tube 4 from the small-diameter shaft 7*g* side at the leading end side of the shaft body portion 7*c* in such a manner that the concave groove 7*k* of the shaft body portion 7*c* is met with the engagement piece 4*e* of the cartridge tube 4, thereby being installed to the cartridge tube 4. Next, the stick-shaped cosmetic material support body 7 is integrated by inserting the base portion 7*a* constructing the stick-shaped cosmetic material support body 7 into the opening at the leading end of the cartridge tube 4, and pressing the coupling tube portion 7*e* to the small-diameter shaft 7*g*. Next, the stick-shaped cosmetic material cartridge 1 shown in FIG. 7 is obtained by inserting the stick-shaped cosmetic material M into the opening at the leading end of the cartridge tube 4 from the rear end portion so as to be supported by the support pieces 7*b* of the stick-shaped cosmetic material support body 7. In this case, the stick-shaped cosmetic material support body 7 is structured such that the rear end surface of the concave groove 7*k* contacts to the engagement piece 4*e* of the cartridge tube 4, thereby the forward movement being limited, and neither appears from the cartridge tube 4 nor is detached from the cartridge tube 4.

Further, as shown in FIGS. 2 and 3, the stick-shaped cosmetic material cartridge 1 obtained as mentioned above is inserted into the opening at the leading end of the cartridge accommodating container 2 via the inner device 5 from the rear end side, and the step surface 4*i* of the cartridge tube 4 is contacted to the leading end surface of the inner device 5. Accordingly, the annular groove portion 4*f* of the cartridge tube 4 is engaged with the protruding portion 5*d* of the spring portion 5*y* of the inner device 5 in the axial direction, the cartridge tube 4 is installed to the cartridge accommodating container 2 via the inner device 5 so as to be relatively rotatable and be detachable in the axial direction, and the rib 2*y* at the upper stage of the cartridge accommodating container 2 is positioned between the ribs 6*h* and 6*h* of the thread tube 6 so as to be engaged in the rotating direction, in this state. Thus, the thread tube 6 is installed to the cartridge accommodating container 2 so as to be synchronously rotatable and be movable in the axial direction, whereby it is possible to obtain the stick-shaped cosmetic material feeding container 100 to which the stick-shaped cosmetic material cartridge 1 shown in FIGS. 1 to 3 is installed.

On the other hand, the stick-shaped cosmetic material sharpener 3 installed to the other end side of the cartridge accommodating container 2 of the stick-shaped cosmetic material feeding container 100 is provided for sharpening the leading end portion of the stick-shaped cosmetic material M in a two-edged shape as seen in the long diameter direction, as shown in FIG. 1.

The stick-shaped cosmetic material sharpener 3 is structured, as shown in FIGS. 2, 3, 11 and 12, such as to be provided with a sharpening portion 3*x* for sharpening the stick-shaped cosmetic material M, an installation portion 3*y* for being detachably installed to the cartridge accommodating container 2, and a grip portion 3*z* for being gripped by the user. The sharpening portion 3*x*, the installation portion 3*y* and the grip portion 3*z* are integrally molded by a plastic material corresponding to the same material.

The sharpening portion 3*x* is approximately provided with a sliding portion 3*a*, a blade 3*b* and a slit 3*c*.

The sliding portion 3*a* is constituted by a plate-like member and is structured such as to have a sliding surface 3*d* at an upper side. The sliding surface 3*d* is provided for contacting the leading end portion of the stick-shaped cosmetic material M so as to make a sliding motion in a longitudinal direction (a lateral direction in the drawing), and is formed at a front side (a right side in the drawing) of the slit 3*c*. The sliding surface 3*d* is formed in a V-shape (refer to FIG. 15) set at an inner angle θ corresponding to an acute angle in a view in the longitudinal direction. Further, a back surface of the plate-like member having the sliding surface 3*d* at the upper side is formed in the similar V-shape to the sliding surface 3*d*.

The blade 3*b* is constituted by a plate-like member, and is provided in such a manner that a blade edge 3*e* facing toward a front side is opposed to a rear end edge 3*f* of the sliding surface 3*d* at a position which is somewhat higher than the sliding surface 3*d*. The blade 3*b* is structured such that a single blade having a blade back arranged at an upper side is made to be a cutting blade, and is structured such as to have a continuous surface 3*g* at an upper side.

The continuous surface 3*g* allows a continuous sliding motion from a sliding motion executed by contacting the leading end portion of the stick-shaped cosmetic material M to the sliding surface 3*d*, and is formed at a rear side (a left side in the drawing) of the slit 3*c*. It becomes possible to execute the continuous sliding motion from the sliding motion executed by contacting the leading end portion of the stick-shaped cosmetic material M to the sliding surface 3*d*, on the basis of the continuous surface 3*g* mentioned above, and it becomes possible to sharpen the leading end portion of the stick-shaped cosmetic material M into the two-edged shape in the view in the longitudinal direction through such the continuous sliding motion.

In this case, the blade 3*b* is formed in the V-shape set at the inner angle θ corresponding to the same acute angle as that of the sliding surface 3*d* in the view in the longitudinal direction, as shown in FIG. 15. Further, as shown in FIGS. 2, 3, 11 and 12, the back surface of the plate-like member having the continuous surface 3*g* at the upper side as well as having the blade edge 3*e* at the front side is formed in the same V-shape as the continuous surface 3*g*.

The slit 3*c* is provided between the sliding surface 3*d* and the continuous surface 3*g*, is formed in the V-shape in the view in the longitudinal direction, and is provided for bringing down a sharpening waste generated by the sharpening operation through the sliding motion executed over the sliding surface 3*d* to the continuous surface 3*g*.

Further, guide rails 3*h* extending in the longitudinal direction from the sliding surface 3*d* to the continuous surface 3*g* are provided at the upper side than the sliding portion 3*a*, the blade 3*b* and the slit 3*c*. The guide rails 3*h* are provided for guiding the leading end portion of the stick-shaped cosmetic material feeding container 100 in a direction of sharpening of the leading end portion of the stick-shaped cosmetic material M fed out from the stick-shaped cosmetic material feeding container 100 in the two-edged shape.

Specifically, the guide rails 3*h* are respectively provided at the upper sides than the sliding surface 3*d* and the continuous surface 3*g* in such a manner as to face to each other at the both sides of the sliding surface 3*d* and the continuous surface 3*g*, and are provided as a pair of step portions having a bottom portion 3*ha* for regulating an oscillation in the vertical direction at a time when the leading end of the stick-shaped cosmetic material feeding container 100 slides, and a side portion 3*hb* for regulating an oscillation in the lateral direction as shown in FIG. 15.

Further, as shown in FIGS. 11 and 12, the sharpening portion 3*x* provided with the sliding portion 3*a*, the blade 3*b*, the slit 3*c* and the guide rail 3*h* is structured such that an outer peripheral surface of a side portion in the lateral direction in the view in the longitudinal direction is formed as a circular arc surface so as to be accommodated within the cartridge accommodating container 2, and is structured approximately in an M-shape in the view in the longitudinal direction.

The installation portion 3*y* is continuously provided on a front surface (a right end surface in the drawing) of the plate-like member having the sliding surface 3*d* of the sharpening portion 3*x* at an upper side, and is structured in a closed-end cylindrical shape having approximately the same diameter as the outer peripheral circular arc surfaces of the sharpening portion 3*x*. A male thread 3*i* is provided on an outer peripheral surface of the installation portion 3*y* so as to be engaged with the female thread 2*f* of the cartridge accommodating container 2.

The grip portion 3*z* is continuously provided on a front surface of the installation portion 3*y*, and is structured in a cylindrical shape having a larger diameter than that of the installation portion 3*y*. An annular protruding portion 3*j* for installing the tail valve 10 is provided on an inner peripheral surface at a front side of the grip portion 3*z*.

The tail valve 10 is provided for closing tube holes of the installation portion 3*y* and the grip portion 3*z* from an outer side, is structured in a closed-end cylindrical shape, and is provided with a collar portion 10*a* in a bottom portion. An annular groove portion 10*b* is provided as a structure engaging with the annular protruding portion 3*j* of the grip portion 3*z*, on an outer peripheral surface of the tail valve 10.

The tail valve 10 is structured, as shown in FIGS. 2 and 3, such that a portion at a rear side from the collar portion 10*a* is inserted into the tube hole of the grip portion 3*z* of the stick-shaped cosmetic material sharpener 3, and the annular groove portion 10*b* is engaged with the annular protruding portion 3*j* of the grip portion 3*z*, whereby the tail valve 10 is installed to the stick-shaped cosmetic material sharpener 3.

Further, the stick-shaped cosmetic material sharpener 3 covered by the tail valve 10 is structured such that the sharpening portion 3*x* and the installation portion 3*y* are inserted into the cartridge accommodating container 2, and the male thread 3*i* of the installation portion 3*y* is engaged with the female thread 2*f* of the cartridge accommodating container 2, whereby the stick-shaped cosmetic material sharpener 3 is detachably installed to the cartridge accommodating container 2. The stick-shaped cosmetic material feeding container 100 shown in FIGS. 1 to 3 is thus obtained.

In the stick-shaped cosmetic material feeding container 100 mentioned above, as shown in FIG. 4, there is employed the stick-shaped cosmetic material M in which the cross sectional shape is formed in a shape having the long diameter and the short diameter, four support pieces 7*b* of the stick-shaped cosmetic material support body 7 supporting the rear end portion of the stick-shaped cosmetic material M are structured such as to respectively support the inclined surfaces Ma between the long diameter and the short diameter of the stick-shaped cosmetic material M, the forward and backward moving hole 4*a* in which the stick-shaped cosmetic material M and the support pieces 7*b* move forward and backward is formed in the cross sectional shape having the long diameter and the short diameter, and has the flat short diameter side inner peripheral surfaces 4*aa* at the short diameter side, the short diameter side inner peripheral surfaces 4*aa* come close to the outer peripheral surfaces Mb at the short diameter side of the stick-shaped cosmetic material M, and the inner peripheral surfaces 4*ab* at the support piece 7*b* side are structured such as to come close to the outer peripheral surfaces 7*bb* at an outer side in the short diameter direction of the support pieces 7*b*. Accordingly, the stick-shaped cosmetic material M formed in the cross sectional shape having the long diameter and the short diameter, and the support pieces 7*b* supporting the stick-shaped cosmetic material M are efficiently accommodated within the container 100 (cartridge tube 4) so as to be movable forward and backward, and the leading end side of the container 100 is formed in a slim and compact shape.

Further, since the forward and backward moving hole 4*a* is formed as the hole in which the cross sectional shape is approximately the rectangular shape, the shape of the forward and backward moving hole 4*a* is simple, and it is easy to manufacture the forward and backward moving hole 4*a*.

Next, a description will be given of a use of the stick-shaped cosmetic material feeding container 100. When the user relatively rotates in one direction, while holding the cartridge accommodating container 2, and the outer diameter large-diameter portion 4*x* protruding from the cartridge accommodating container 2 in the cartridge tube 4 of the stick-shaped cosmetic material cartridge 1, the stick-shaped cosmetic material support body 7 is moved forward in accordance with the thread portion 50 constituted by the engagement projection 6*a* of the thread tube 6 and the male thread 7*j* of the stick-shaped cosmetic material support body 7, and the rotation preventing portion 60 constituted by the concave groove 7*k* of the stick-shaped cosmetic material support body 7 and the engagement piece 4*e* of the cartridge tube 4, so that the stick-shaped cosmetic material M appears from the leading end of the cartridge tube 4 and it becomes possible to apply it.

At the applying time when the stick-shaped cosmetic material M appears from the leading end of the cartridge tube 4, the thick line can be drawn by moving the stick-shaped cosmetic material M in the short diameter direction, and the thin line can be drawn by moving the stick-shaped cosmetic material M in the long diameter direction. Accordingly, it is possible to draw the desired thin and thick lines.

Further, when the user relatively rotates the cartridge accommodating container 2 and the cartridge tube 4 of the stick-shaped cosmetic material cartridge 1 in the other direction corresponding to the opposite direction to one direction, the stick-shaped cosmetic material support body 7 is moved backward, and the stick-shaped cosmetic material M is brought in from the leading end of the cartridge tube 4.

In this case, if impulsive external force is applied, for example, by dropping the stick-shaped cosmetic material feeding container 100 on the floor or the like, the stick-shaped cosmetic material cartridge 1 is moved in accordance with an expansion and contraction amount of the spring portion 5*y* of the inner device 5 in the axial direction, and the shock is buffered, whereby the stick-shaped cosmetic material M within the stick-shaped cosmetic material cartridge 1 is prevented from jumping out or being broken.

Further, in the present embodiment, since the flat short diameter side inner peripheral surfaces 4*aa* at the short diameter side of the forward and backward moving hole 4*a* come close to the outer peripheral surfaces Mb at the short diameter side of the stick-shaped cosmetic material M, the outer peripheral surfaces Mb at the short diameter side of the stick-shaped cosmetic material M is immediately borne by the short diameter side inner peripheral surfaces 4*aa* of the forward and backward moving hole 4*a* which are close to the outer peripheral surfaces Mb, even if stress is applied in the short diameter direction to the stick-shaped cosmetic material M which has a small thickness and is comparatively weak against the stress. Accordingly, it is possible to prevent the stick-shaped cosmetic material M from being broken by the stress in the short diameter direction.

Further, since the inner peripheral surfaces 4*ac* at the long diameter side of the forward and backward moving hole 4*a* come close to the outer peripheral surfaces Mc at the long diameter side of the stick-shaped cosmetic material M, in addition that the stick-shaped cosmetic material M has the large thickness in the long diameter direction and is comparatively strong against the stress in the long diameter direction so as to be hardly broken, the outer surfaces Mc at the long diameter side of the stick-shaped cosmetic material M is immediately borne by the inner peripheral surfaces 4*ac* at the long diameter side of the forward and backward moving hole 4*a* which come close to the outer surfaces Mc, even if the stress is applied in the long diameter direction to the stick-shaped cosmetic material M, so that it is possible to prevent the stick-shaped cosmetic material M from being broken by the stress in the long diameter direction.

Next, a description will be given of the case that the leading end portion of the stick-shaped cosmetic material M is rounded by the use of the stick-shaped cosmetic material M, and the sharpening work of the leading end portion is executed. In this case, the stick-shaped cosmetic material sharpener 3 is detached from the cartridge accommodating container 2 by canceling the engagement of the stick-shaped cosmetic material sharpener 3, and the sharpening work is executed while holding the cartridge accommodating container 2 by one hand and holding the stick-shaped cosmetic material sharpener 3 by the other hand. In this case, it is also possible to execute the sharpening work by holding the stick-shaped cosmetic material cartridge 1 after detaching the stick-shaped cosmetic material cartridge 1 from the cartridge accommodating container 2, however, in this case, the sharpening work is executed while holding the cartridge accommodating container 2.

In the sharpening work, as shown in FIGS. 13 to 15, the user presses a whole surface of the leading end surface 70 of the stick-shaped cosmetic material feeding container 100 to the bottom portions 3*ha* of the guide rails 3*h* in a state in which the stick-shaped cosmetic material M protrudes from the leading end of the stick-shaped cosmetic material cartridge 1 (the cartridge tube 4) (refer to FIG. 15). At this time, it is preferable that a protruding amount of the stick-shaped cosmetic material M from the container 100 is set to an amount capable of sharpening the leading end portion of the stick-shaped cosmetic material M, or in specific, an amount at which the leading end surface of the stick-shaped cosmetic material M contacts with the sliding surface 3*d*.

Further, in this state, the user moves the stick-shaped cosmetic material feeding container 100 in the longitudinal direction while being guided along the guide rails 3*h*. It is possible to prevent the leading end portion of the stick-shaped cosmetic material feeding container 100 from being oscillated at a time of sharpening, by being guided along the guide rails 3*h*, and it is possible to stably obtain a desired two-edged shape.

Specifically, it is possible to regulate the oscillation in the vertical direction at a time of sliding of the leading end portion of the stick-shaped cosmetic material feeding container 100, by the bottom portions 3*ha* of the guide rails 3*h*, and it is possible to regulate the oscillation in the lateral direction at a time of sliding of the leading end portion of the stick-shaped cosmetic material feeding container 100, by the side portions 3*hb* of the guide rails 3*h*. Accordingly, it is possible to securely prevent the oscillation of the leading end portion of the stick-shaped cosmetic material feeding container 100 at a time of sharpening, and it is possible to stably obtain a desired two-edged shape.

In other words, a user having no special technique can execute the sharpening work of the leading end portion of the stick-shaped cosmetic material M securely in a short time, and it is possible to stably obtain the desired two-edged shape.

Further, in the stick-shaped cosmetic material sharpener 3, since it is possible to execute the sharpening work without directly holding the stick-shaped cosmetic material M, it is possible to prevent the user's hands from being got dirty.

In the case that the sharpening work is executed while holding the stick-shaped cosmetic material cartridge 1, the sharpening work is executed by utilizing the guide rails 3*h* in the same manner as mentioned above, with the leading end portion of the stick-shaped cosmetic material cartridge 1 instead of the leading end portion of the stick-shaped cosmetic material feeding container.

As described above, particularly in the present embodiment, it is possible to form the leading end side of the container 100 in the slim and compact shape, by designing the shapes of the support pieces 7*b* and the forward and backward moving hole 4*a* as mentioned above.

Further, particularly in the present embodiment, since it is possible to sharpen the stick-shaped cosmetic material M into the two-edged shape by holding the stick-shaped cosmetic material feeding container 100 or the stick-shaped cosmetic material cartridge 1 and utilizing the guide by means of the guide rails 3*h*, at a time of sharpening the stick-shaped cosmetic material M by using the stick-shaped cosmetic material sharpener 3, it is possible to stably obtain the desired two-edged shape without getting the user's hands dirty.

FIG. 16 is a cross sectional view showing a stick-shaped cosmetic material feeding container in accordance with a second embodiment of the present invention, FIG. 17 is a cross sectional view showing a stick-shaped cosmetic material feeding container in accordance with a third embodiment of the present invention, and these drawings are the cross sectional views corresponding to FIG. 4.

These stick-shaped cosmetic material feeding containers in accordance with the second and third embodiments are different from the stick-shaped cosmetic material feeding container 100 in accordance with the first embodiment in a point that the shape of the outer peripheral surface at the long diameter side of the stick-shaped cosmetic material M is changed. The other structures of the stick-shaped cosmetic material than the above point, and the structures of the forward and backward moving hole 4*a* and the support pieces 7*b* are the same as those of the first embodiment.

Specifically, in the second embodiment shown in FIG. 16, there is employed a stick-shaped cosmetic material M1 in which the outer peripheral surface at the long diameter side is set to a flat surface M1*c*. In the third embodiment shown in FIG. 17, there is employed a stick-shaped cosmetic material M2 in which the outer peripheral surface at the long diameter side is set to a sharp end M2*c* in an approximately tilted L-shape.

In the stick-shaped cosmetic material feeding containers in accordance with the second and third embodiments mentioned above, it is possible to obtain approximately the same effects as those of the first embodiment.

FIG. 18 is a cross sectional view showing a stick-shaped cosmetic material feeding container in accordance with a fourth embodiment of the present invention, and the cross sectional view corresponds to that in FIG. 4.

The stick-shaped cosmetic material feeding container in accordance with the fourth embodiment is different from the stick-shaped cosmetic material feeding container 100 in accordance with the first embodiment in a point that the shape of the inner peripheral surface 4*ac* at the long diameter side of the forward and backward moving hole 4*a* is changed as that of a forward and backward moving hole 14*a*. Specifically, the forward and backward moving hole 14*ac* is structured by removing the convexes of the peripheral wall at the long diameter side constituting the forward and backward moving hole, and making inner peripheral surfaces 14*ac* at a long diameter side of the forward and backward moving hole 14*a* to be a flat surface. The other structures of the forward and backward moving hole than the above point, and the structures of the stick-shaped cosmetic material M and the support pieces 7*b* are the same as those of the first embodiment. Further, in accordance with the structure mentioned above, the forward and backward moving hole 14*a* is formed as a hole in which the cross sectional shape is rectangular.

Even in the stick-shaped cosmetic material feeding container in accordance with the fourth embodiment mentioned above, it is possible to obtain approximately the same effects as those of the first embodiment. In addition, since the forward and backward moving hole 14*a* is formed as the rectangular hole, the hole shape is made further simple and it is possible to more easily manufacture.

In this case, the shape of the forward and backward moving hole 14*a* mentioned above can be of course applied to the stick-shaped cosmetic materials M1 and M2 in accordance with the second and third embodiments.

The description is specifically given above of the present invention on the basis of the embodiments, however, the present invention is not limited to the embodiments mentioned above. For example, in the embodiments mentioned above, the stick-shaped cosmetic material cartridge 1 is structured detachably, however, may be structured to be undetectably. Further, the present invention can be applied to the other types of stick-shaped cosmetic material feeding container than the cartridge type.

Further, the stick-shaped cosmetic material is not limited to the structure mentioned above, but can be structured as a stick-shaped cosmetic material having an oval cross sectional shape, or the like.

Further, in the embodiment mentioned above, the male thread and the female thread may be replaced by those which have the same function as thread ridges such as an intermittently arranged projection group or a spirally and intermittently arranged projection group, and the engagement projection may be replaced by a continuous thread ridges.

Further, in the embodiment mentioned above, the stick-shaped cosmetic material sharpener 3 is structured such that the sliding surface 3*d* and the continuous surface 3*g* are formed in the V-shape in the view in the longitudinal direction, so as to sharpen the leading end portions of the stick-shaped cosmetic materials M to M2 in the two-edged shape, however, may be structured, for example, such that the sliding surface 3*d* and the continuous surface 3*g* are formed approximately in a √-shape in the view in the longitudinal direction, so as to sharpen the leading end portions of the stick-shaped cosmetic materials M to M2 approximately in the √-shaped single edged shape. In short, it is preferable that the sliding surface 3*d* and the continuous surface 3*g* are formed in an acute shape, in which their inner angles are set to an acute angle in the view in the longitudinal direction, so as to sharpen the leading end portions of the stick-shaped cosmetic materials M to M2 into the acute angle shape.

What is claimed is:

1. A stick-shaped cosmetic material feeding container comprising a stick-shaped cosmetic material support body supporting a rear end portion of a stick-shaped cosmetic material with a plurality of support pieces, said stick-shaped cosmetic material being moved forward and backward together with the stick-shaped cosmetic material support body, wherein said stick-shaped cosmetic material has a cross sectional shape having material long diameter sides and material short diameter sides, and inclined surfaces respectively between each adjacent material long diameter side and material short diameter side, wherein said support body has four support pieces for respectively supporting the inclined surfaces of said stick-shaped cosmetic material, wherein an inside section of said container has a receiving hole formed therein, and said stick-shaped cosmetic material and said support pieces are moved forward and backward in said receiving hole, wherein said receiving hole has a cross sectional shape having a hole long diameter and a hole short diameter generally corresponding to the cross sectional shape of said stick-shaped cosmetic material, said container having first flat hole short diameter inner peripheral surfaces on opposite sides of said hole short diameter and second hole short diameter inner peripheral surfaces in proximity to said first hole short diameter inner peripheral surfaces, wherein said first hole short diameter inner peripheral surfaces are adjacent said material short diameter sides, and said second hole short diameter inner peripheral surfaces are adjacent said support pieces.

2. A stick-shaped cosmetic material feeding container as claimed in claim 1, wherein said second hole short diameter inner peripheral surfaces do not protrude to an outer side in a direction of said hole short diameter from said first hole short diameter inner peripheral surfaces.

3. A stick-shaped cosmetic material feeding container as claimed in claim 2, further comprising hole long diameter inner peripheral surfaces at opposite sides of said hole long diameter, wherein said hole long diameter inner peripheral surfaces are adjacent said material long diameter sides.

4. A stick-shaped cosmetic material feeding container as claimed in claim 3, wherein said receiving hole has a substantially rectangular shape in cross section.

5. A stick-shaped cosmetic material feeding container as claimed in claim 2, wherein said receiving hole has a substantially rectangular shape in cross section.

6. A stick-shaped cosmetic material feeding container as claimed in claim 1, further comprising hole long diameter inner peripheral surfaces at opposite sides of said hole long diameter, wherein said hole long diameter inner peripheral surfaces are adjacent said material long diameter sides.

7. A stick-shaped cosmetic material feeding container as claimed in claim 6, wherein said receiving hole has a substantially rectangular shape in cross section.

8. A stick-shaped cosmetic material feeding container as claimed in claim 1, wherein said receiving hole has a substantially rectangular shape in cross section.

* * * * *